US010661426B2

(12) United States Patent
Aoki

(10) Patent No.: US 10,661,426 B2
(45) Date of Patent: May 26, 2020

(54) WORK TOOL WITH VIBRATION DAMPERS

(71) Applicant: MAKITA CORPORATION, Anjo-shi, Aichi (JP)

(72) Inventor: Yonosuke Aoki, Anjo (JP)

(73) Assignee: MAKITA CORPORATION, Anjo (JP)

( * ) Notice: Subject to any disclaimer, the term of this patent is extended or adjusted under 35 U.S.C. 154(b) by 245 days.

(21) Appl. No.: 15/435,366

(22) Filed: Feb. 17, 2017

(65) Prior Publication Data

US 2017/0239802 A1 Aug. 24, 2017

(30) Foreign Application Priority Data

Feb. 19, 2016 (JP) ..... 2016-030370
Feb. 19, 2016 (JP) ..... 2016-030372

(51) Int. Cl.
*B25F 5/00* (2006.01)
*B25F 5/02* (2006.01)

(52) U.S. Cl.
CPC ..... *B25F 5/006* (2013.01); *B25F 5/008* (2013.01); *B25F 5/02* (2013.01)

(58) Field of Classification Search
CPC B25B 5/006; B25B 5/008; B25B 5/02; B24B 23/04
USPC ..... 173/162.1
See application file for complete search history.

(56) References Cited

U.S. PATENT DOCUMENTS 3,728,793 A * 4/1973 Makinson ..... B27B 17/02 30/383
4,543,718 A * 10/1985 Duescher ..... A61F 15/02 30/124
4,611,671 A * 9/1986 Hansson ..... B25F 5/006 173/162.2

(Continued)

FOREIGN PATENT DOCUMENTS

JP S61-501072 A 5/1986
JP 2001-510099 A 7/2001

(Continued)

OTHER PUBLICATIONS

Jul. 3, 2018 Extended Search Report issued in European Patent Application No. 18162566.6.

(Continued)

*Primary Examiner* — Alex M Valvis
*Assistant Examiner* — Katie L Gerth
(74) *Attorney, Agent, or Firm* — Oliff PLC

(57) ABSTRACT

It is an object of the invention to provide a more rational vibration reducing technique for a work tool. A representative work tool 100 has an outer housing 102, an inner housing 104, a brushless motor 115, a spindle 124 having a rotation axis extending in parallel to a rotation output shaft of the brushless motor 115 and configured to be rotated on the rotation axis within a prescribed angular range to drive a tool accessory 145, a front elastic member 110*a* disposed between a front inner housing region 104*a* and a front outer housing region 102*a*, and a rear elastic member 110*c* dis- (Continued)

posed between at least one of an intermediate inner housing region 104*b* and a rear inner housing region 104*c* and at least one of an intermediate outer housing region 102*b* and a rear outer housing region 102*c*.

15 Claims, 17 Drawing Sheets

(56) References Cited

U.S. PATENT DOCUMENTS 5,027,910 A * 7/1991 Honsa ..... B25D 17/24 173/162.1
5,640,741 A * 6/1997 Yano ..... B25F 5/006 16/421
6,286,610 B1 9/2001 Berger et al.
6,643,939 B2 * 11/2003 Tajima ..... B27B 17/0033 173/162.2
7,052,382 B2 * 5/2006 Baker ..... B23B 45/003 451/344
7,217,178 B2 * 5/2007 Oki ..... B25F 5/006 451/358
8,113,922 B2 * 2/2012 Esenwein ..... B24B 23/028 310/47
8,684,105 B2 * 4/2014 Yoshikane ..... B25D 16/003 173/178
8,833,486 B2 * 9/2014 Krauter ..... B25F 5/006 173/162.1
8,952,581 B2 * 2/2015 Naito ..... H02K 9/06 310/50
10,160,111 B2 * 12/2018 Blickle ..... B25F 5/006
2004/0035009 A1 * 2/2004 Richards ..... A01G 3/053 30/381
2004/0094315 A1 * 5/2004 Chang ..... B25F 5/006 173/210
2006/0113098 A1 * 6/2006 Inagawa ..... B24B 23/028 173/162.2
2007/0034396 A1 * 2/2007 Berger ..... B25D 17/043 173/162.2
2007/0295522 A1 * 12/2007 Bohne ..... B25D 17/043 173/162.2
2008/0041603 A1 * 2/2008 Wiker ..... B25F 5/006 173/162.1
2008/0142236 A1 * 6/2008 Walker ..... B25B 21/00 173/40
2008/0153401 A1 * 6/2008 Wuensch ..... B25F 5/006 451/344
2009/0194306 A1 * 8/2009 Johnson ..... B25F 5/006 173/162.1
2009/0308213 A1 12/2009 Zaiser et al.
2010/0003906 A1 1/2010 Zaiser et al.
2010/0095533 A1 * 4/2010 Takahashi ..... A01G 3/053 30/228
2011/0083868 A1 * 4/2011 Nishikimi ..... B25F 5/02 173/171
2011/0303718 A1 * 12/2011 Spasov ..... B25C 1/06 227/2
2012/0037391 A1 * 2/2012 Clabunde ..... B23Q 11/0032 173/162.1
2012/0111595 A1 * 5/2012 Schadow ..... B25F 5/006 173/162.2
2012/0125648 A1 * 5/2012 Schadow ..... B25F 5/006 173/46
2012/0129435 A1 * 5/2012 Ikuta ..... B25F 5/006 451/358
2014/0048301 A1 2/2014 Okouchi et al.
2014/0174777 A1 * 6/2014 Kakiuchi ..... B25D 17/20 173/117
2014/0326477 A1 * 11/2014 Thorson ..... B23Q 11/0032 173/171
2015/0034347 A1 * 2/2015 Hess ..... B25F 5/006 173/162.2
2015/0135541 A1 * 5/2015 Wierzchon ..... B27B 19/006 30/276
2015/0217422 A1 * 8/2015 Esenwein ..... B24B 23/04 173/217
2015/0263592 A1 9/2015 Kawakami et al.
2015/0367495 A1 * 12/2015 Takeda ..... B25F 5/02 451/359
2017/0008160 A1 * 1/2017 Simma ..... B25F 5/006

FOREIGN PATENT DOCUMENTS

JP 2013-226617 A 11/2013
JP 2014-037037 A 2/2014
WO 85/03473 A1 8/1985
WO 2008128802 A1 10/2008
WO 2015/140029 A1 9/2015

OTHER PUBLICATIONS

Jul. 6, 2017 Extended Search Report issued in European Patent Application No. 17156579.9.
Oct. 3, 2019 Office Action issued in Japanese Patent Application No. 2016-03070.
Oct. 4, 2019 Office Action issued in Japanese Patent Application No. 2016-030372.

* cited by examiner

WORK TOOL WITH VIBRATION DAMPERS

TECHNICAL FIELD

The present invention relates to a work tool which performs a prescribed operation on a workpiece by driving a tool accessory.

BACKGROUND ART

WO 2008-128802 discloses a hand-held work tool which transmits an output of a driving motor to a spindle to drive a tool accessory. In this work tool, the spindle and an output shaft of the motor are arranged substantially in parallel to each other.

SUMMARY OF THE INVENTION

Problem to be Solved by the Invention

In the above-described work tool, the spindle and the output shaft of the motor can be arranged close to each other by the parallel arrangement, so that the work tool can be reduced in size. However, a housing of the work tool has a housing region for a tool accessory driving mechanism including the spindle, a housing region for a motor and a holding region to be held by a user, and these regions are contiguously and integrally formed together In this work tool, the relatively heavy parts (the tool accessory driving mechanism and the motor) arranged close to each other are likely to be locally unevenly distributed. This may lead to reduction of the moment of inertia of the housing, so that vibration may be increased during operation.

Accordingly, it is an object of the present invention to provide a more rational vibration reducing technique for a work tool.

Representative Embodiment of the Invention

The above-described problem is solved by the present invention. According to the present invention, a work tool is provided which performs a prescribed operation on a workpiece by driving a tool accessory. The work tool has an outer housing extending in an elongate form, an inner housing provided in the outer housing, a brushless motor, and a spindle having a rotation axis extending in parallel to a rotation output shaft of the brushless motor and configured to be rotated on the rotation axis within a prescribed angular range via the brushless motor to drive the tool accessory.

In a longitudinal direction which is defined as an extending direction of the elongate outer housing, the outer housing is configured to have a front outer housing region that defines a front part of the outer housing, a rear outer housing region that defines a rear part of the outer housing, and an intermediate outer housing region that defines an intermediate part between the front outer housing region and the rear outer housing region. The intermediate outer housing region is preferably used to be held by a user.

The inner housing has a front inner housing region that is arranged within the front outer housing region, a rear inner housing region that is arranged within the rear outer housing region, and an intermediate inner housing region that is arranged within the intermediate outer housing region. At least the brushless motor is disposed in the front inner housing region. In addition to the brushless motor, typically, the above-described spindle and a transmission driving mechanism that transmits rotation of the brushless motor to the spindle to drive the spindle are preferably disposed in the front inner housing region. Further, the brushless motor may be suitably disposed in its entirety or in part in the front inner housing region.

The work tool according to the present invention further has a front elastic member disposed between the front inner housing region and the front outer housing region. The front elastic member is typically a spring element or a rubber element which connects the front inner housing region and the front outer housing region.

The work tool according to the present invention further has a rear elastic member disposed between at least one of the intermediate inner housing region and the rear inner housing region and at least one of the intermediate outer housing region and the rear outer housing region. The manner of arrangement of the rear elastic member between these regions typically includes a first manner of elastically connecting the rear inner housing region and the rear outer housing region, a second manner of elastically connecting the intermediate inner housing region and the intermediate outer housing region, and a third manner combining the first and second manners. Further, it suitably includes a fourth manner of elastically connecting the intermediate inner housing region and the rear outer housing region, a fifth manner of elastically connecting the rear inner housing region and the intermediate outer housing region, and a sixth manner combining the fourth and fifth manners. Further, it also includes a manner of elastically connecting a relatively wide area extending from the intermediate inner housing region to the rear outer housing region and a relatively wide area extending from the intermediate outer housing region to the rear outer housing region by a (single) rear elastic member.

As described above, in addition to the brushless motor, typically, the front inner housing region houses the spindle for driving the tool accessory and various kinds of mechanical elements relating to driving of the spindle. By such arrangement, however, relatively large vibration is easily caused in the front inner housing region during operation. According to this invention, by providing the front and rear elastic members between the inner housing and the outer housing, vibration of the front inner housing region is effectively prevented from being transmitted to the outer housing side. Especially, in this invention, the front and rear elastic members prevent transmission of vibration from the front inner housing region to the intermediate outer housing region which is used as a handle part to be held by a user during operation. Thus, the vibration reducing or proofing characteristic is enhanced from the viewpoint of users.

In this invention, the rotation axis of the spindle and the rotation axis of the brushless motor are arranged in parallel to each other. Only considering this point, concerns may arise that the close arrangement of the heavy parts may cause reduction of the moment of inertia of the inner housing, resulting in increase of vibration. In this invention, however, by disposing the above-described front and rear elastic members between the inner housing and the outer housing, vibration caused in the inner housing is effectively prevented from being transmitted to the outer housing during operation.

In the work tool according to the present invention, the spindle is configured to be rotated on the rotation axis of the spindle within a prescribed angular range. It may be configured such that the "prescribed angle" is fixed to a constant angle or varied by prescribed operation. Further, typically, it is preferably configured such that the rotation period of the spindle within a prescribed angular range is constant, but it may also be configured such that the rotation period is varied by prescribed operation.

Further, the tool accessory may widely include tools capable of performing operation by being driven by the spindle rotating on the rotation axis within a prescribed angular range. The operation to be performed includes a cutting operation, a scraping operation and a grinding operation. The tool accessory may be freely replaced according to the operation. The tool accessory is freely selected from various kinds of tool accessories according to the operation and mounted to the single work tool. Therefore, the work tool may also be referred to as a multi tool.

Further, a clamp shaft may be used to mount the tool accessory to the spindle. Typically, the tool accessory is arranged and held between the clamp shaft and the spindle. In this case, the spindle has a hollow shape extending along the rotation axis and the clamp shaft is inserted through the hollow part. The clamp shaft is configured to be movable in the direction of the rotation axis with respect to the spindle so as to be switched between a tool accessory holding position and a tool accessory releasing position. The clamp shaft holds the tool accessory in the tool accessory holding position during operation, and for replacement of the tool accessory, the clamp shaft is placed in the tool accessory releasing position.

A lock mechanism for the clamp shaft may be preferably provided in order for the clamp shaft to hold and release the tool accessory. The lock mechanism is preferably configured to be movable between an engaging position for locking the clamp shaft in the tool accessory holding position and a disengaging position for unlocking (releasing the lock of) the clamp shaft and allowing the tool accessory to be released. With this structure, the tool accessory is easily held and released through user's manual operation of the lock mechanism.

According to one aspect of the work tool of the present invention, preferably, an intermediate elastic member is further provided at a prescribed location in an area from the front inner housing region to the rear inner housing region via the intermediate inner housing region. The intermediate elastic member is configured to elastically connect the front inner housing region to at least the rear inner housing region. The manner of providing the intermediate elastic member in an area from the front inner housing region "to the rear inner housing region via the intermediate inner housing region" suitably includes a first manner of providing the intermediate elastic member in the intermediate inner housing region, a second manner of providing it between the intermediate inner housing region and the rear inner housing region, and a third manner of providing it in the rear inner housing region.

Further, the structure configured "to elastically connect the front inner housing region to at least the rear inner housing region" is provided such that the front inner housing region for housing (a relatively large number of) operating system members prone to become a vibration source is configured to elastically receive at least the rear inner housing region in order to prevent vibration caused in the front inner housing region from being transmitted to the other inner housing regions (at least the rear inner housing region). For this purpose, in the above-described first manner, the front inner housing region is elastically connected to a part (rear part) of the intermediate inner housing region and the rear inner housing region. In the second manner, the front inner housing region is elastically connected to the rear inner housing region. In the third manner, the front inner housing region is elastically connected to a part (rear part) of the rear inner housing region.

In any of these manners, further vibration reducing measures are taken in the whole work tool by preventing vibration caused in the front inner housing region from being transmitted to the other inner housing regions (at least the rear inner housing region).

In relation to the above-described second manner, it may be suitably configured such that at least part of the intermediate inner housing region is flexible and the flexible part defines the intermediate elastic member. With this structure, a component member of the intermediate inner housing region itself can also be used as the intermediate elastic member, so that a rational member configuration is provided.

According to another aspect of the present invention, a work tool is provided which has substantially the same basic structure. In order to prevent transmission of vibration caused in the front inner housing region, a front elastic member is disposed between the front inner housing region and the front outer housing region, and in place of the above-described rear elastic member, an intermediate elastic member is provided at a prescribed location in an area from the front inner housing region to the rear inner housing region via the intermediate inner housing region and configured to elastically connect the front inner housing region to at least the rear inner housing region. Such a structure also effectively prevents vibration caused in the front inner housing region from being transmitted to the other regions during operation.

In the case of such a structure using the intermediate elastic member in place of the rear elastic member, it may also be suitably configured such that at least part of the intermediate inner housing region is flexible and the flexible part defines the intermediate elastic member.

In the above-described aspects of the invention, it is preferable to provide a battery mounting part in the rear inner housing region. A battery for supplying power to the brushless motor is mounted to the battery mounting part.

According to this aspect of the invention, the relatively heavy part or battery is provided on the rear inner housing region side, while at least the brushless motor is provided on the front inner housing region side. Therefore, compared with a structure in which heavy parts are mainly disposed in the front inner housing region, the inertia of the inner housing can be set high, so that the effect of reducing vibration of the inner housing is enhanced.

According to one aspect of the work tool of the present invention, the work tool may further have a controller for controlling driving of the brushless motor, a connecting part for electrically connecting the brushless motor and the controller, a cooling fan, inlets through which air is take in from outside via the cooling fan, and outlets through which air is discharged to the outside. Preferably, the inlets are formed in the rear inner housing region, and the outlets are formed in the front inner housing region. Further, preferably, an air passage is formed in the intermediate inner housing and configured to provide communication between the inlets and the outlets, and at least part of the connecting part is arranged in the air passage. A feeding cable or a signal transmitting cable is typically used as the connecting part.

In such an aspect, further preferably, the controller is arranged in the rear inner housing. With this structure, while the moment of inertia of the inner housing is further increased, the controller is cooled by air which is taken in through the inlets formed in the rear inner housing, the air is led to the front inner housing region through the air passage of the intermediate inner housing region and cools the brushless motor, and then the air is discharged from the outlets formed in the front inner housing. Thus, the work tool having a rational structure is provided.

According to one aspect of the work tool of the present invention, the intermediate outer housing region is preferably configured to have a thin part having a smaller width than the front and rear outer housing regions in a transverse direction, when an extending direction of the rotation axis of the spindle is defined as a vertical direction and a direction crossing the longitudinal direction and the vertical direction is defined as the transverse direction. A handle part which fits well to a hand of a user is easily provided by utilizing the thin part.

(Second Aspect of the Invention)

The above-described problem is solved by the second invention. According to the second invention, a work tool is provided which performs a prescribed operation on a workpiece by driving a tool accessory. The work tool has a housing extending in an elongate form, a brushless motor, a controller for controlling driving of the brushless motor, and a spindle having a rotation axis extending in parallel to a rotation output shaft of the brushless motor and configured to be rotated on the rotation axis within a prescribed angular range via the brushless motor to drive the tool accessory.

In a longitudinal direction which is defined as an extending direction of the elongate housing, the housing has a front housing region that defines a front region of the housing, a rear housing region that defines a rear region of the housing, and an intermediate housing region that defines an intermediate part between the front housing region and the rear housing region. At least the brushless motor is disposed in the front inner housing region. In addition to the brushless motor, typically, the above-described spindle and a transmission driving mechanism that transmits rotation of the brushless motor to the spindle and drives the spindle are preferably disposed in the front inner housing region. Further, the brushless motor may be suitably disposed in its entirety or in part in the front inner housing region.

The controller (controlling device) is disposed in the rear housing region. In the second invention, where the brushless motor is used, the controller is typically a brushless motor driving control module (pre-assembly unit) having a switching element, a central processing unit (CPU) and a capacitor on a substrate. The brushless motor driving control module may typically include various kinds of driving control circuits such as a power supply circuit, a comparator circuit, a current control circuit, a logic circuit and a power circuit. Further, the controller may suitably include controlling devices other than the brushless motor driving control module, such as a controlling device for electrical equipment mounted in the work tool, and a combination of the brushless motor driving control module and a controlling device for other electrical equipment.

In the work tool according to the second invention, by arranging the relatively heavy controller in the rear housing region while arranging at least the brushless motor in the front housing region, local uneven distribution (concentrated arrangement) of heavy parts in the housing is avoided and the heavy parts are arranged in a distributed manner in the longitudinal direction within the housing. By this arrangement, the moment of inertia of the housing is increased, so that vibration of the housing is reduced during operation.

In the second invention, the rotation axis of the spindle and the rotation axis of the brushless motor are arranged in parallel to each other. Only considering this point, concerns may arise that the close arrangement of the heavy parts may cause reduction of the moment of inertia of the inner housing, resulting in increase of vibration. In the second invention, however, the relatively heavy controller is arranged in the rear housing region to prevent reduction of the moment of inertia of the housing so that the above-described concerns are eliminated.

In the work tool according to the second invention, the spindle is configured to be rotated on the rotation axis of the spindle within a prescribed angular range. It may be configured such that the "prescribed angle" is fixed to a constant angle or varied by prescribed operation. Further, typically, it is preferably configured such that the rotation period of the spindle within a prescribed angular range is set to a constant period, but it may also be configured such that the rotation period is varied by prescribed operation.

Further, the tool accessory may widely include tools capable of performing operation by being driven by the spindle rotating on the rotation axis within a prescribed angular range. The operation to be performed includes a cutting operation, a scraping operation and a grinding operation. The tool accessory may be freely replaced according to the operation. The tool accessory is freely selected from various kinds of tool accessories according to the operation and mounted to the single work tool. Therefore, the work tool may also be referred to as a multi tool.

Further, a clamp shaft may be used to mount the tool accessory to the spindle. Typically, the tool accessory is arranged and held between the clamp shaft and the spindle. In this case, the spindle has a hollow shape extending along the rotation axis and the clamp shaft is inserted through the hollow part. The clamp shaft is configured to be movable in the direction of the rotation axis with respect to the spindle so as to be switched between a tool accessory holding position and a tool accessory releasing position. The clamp shaft holds the tool accessory in the tool accessory holding position during operation, and for replacement of the tool accessory, the clamp shaft is placed in the tool accessory releasing position.

A lock mechanism for the clamp shaft may be preferably provided in order for the clamp shaft to hold and release the tool accessory. The lock mechanism is preferably configured to be movable between an engaging position for locking the clamp shaft in the tool accessory holding position and a disengaging position for unlocking the clamp shaft and allowing the tool accessory to be released. With this structure, the tool accessory is easily held and released through user's manual operation of the lock mechanism.

According to one aspect of the work tool of the second invention, the work tool may be configured to further have an outer housing, an inner housing which is formed by the housing and housed within the outer housing, and an elastic member configured to elastically connect the outer housing and the inner housing to prevent vibration caused in the inner housing from being transmitted to the outer housing. Typically, part of the outer housing may be used as a handle part which is held by a user. With this structure, the elastic member effectively prevents vibration caused on the housing side or the inner housing side from being transmitted to the outer housing side which is held by a user during operation.

According to one aspect of the work tool of the second invention, the work tool may further have an inlet formed in the rear housing region, an outlet formed in the front housing region and an air passage formed within the intermediate housing region. Further, the controller and the brushless motor may be arranged on an air flow path extending from the inlet to the outlet via the air passage. With this structure, the controller disposed in the rear housing region and the brushless motor disposed in the front housing region can be efficiently and rationally cooled. Further, by providing the inlet in the rear housing region, dust generated during operation is prevented from being sucked into the work tool through the inlet.

In this aspect of the invention, typically, a cooling fan which is driven by the brushless motor is suitably used to take in and discharge air. Further, the cooling fan is suitably mounted onto the rotation output shaft of the brushless motor.

In this aspect of the invention, an air passage may be formed between the intermediate housing region and the outer housing so that a cooling-air flow path is provided to extend from the inlet to the outlet via the air passage. The controller and the brushless motor may be arranged on the cooling-air flow path.

Further, in this aspect of the invention, the controller may be disposed within the rear inner housing region and immediately downstream of the inlet through which air is sucked in. The controller is typically configured as a brushless motor driving control module having a switching element and an inverter. In this case, the controller which is expected to generate a considerable amount of heat is efficiently cooled in a region immediately downstream of the inlet by air which is sucked in through the inlet.

In the above-described aspects of the invention, a connecting part for electrically connecting the controller and the brushless motor may be at least partly arranged in the air passage. A feeding cable or a signal transmitting cable may be typically used as the connecting part.

EMBODIMENTS FOR CARRYING OUT THE INVENTION

Representative embodiments of a work tool according to the present invention are now described with reference to FIGS. 1 to 17. FIGS. 1 to 13 show a work tool according to a first embodiment, and FIGS. 14 to 17 show a work tool according to a second embodiment.

Parts and mechanisms of the work tool in the second embodiment which are substantially identical or similar to those in the first embodiment are given like designations and numerals as in the first embodiment and will not be further elaborated in the second embodiment.

First Embodiment

Figure 1:
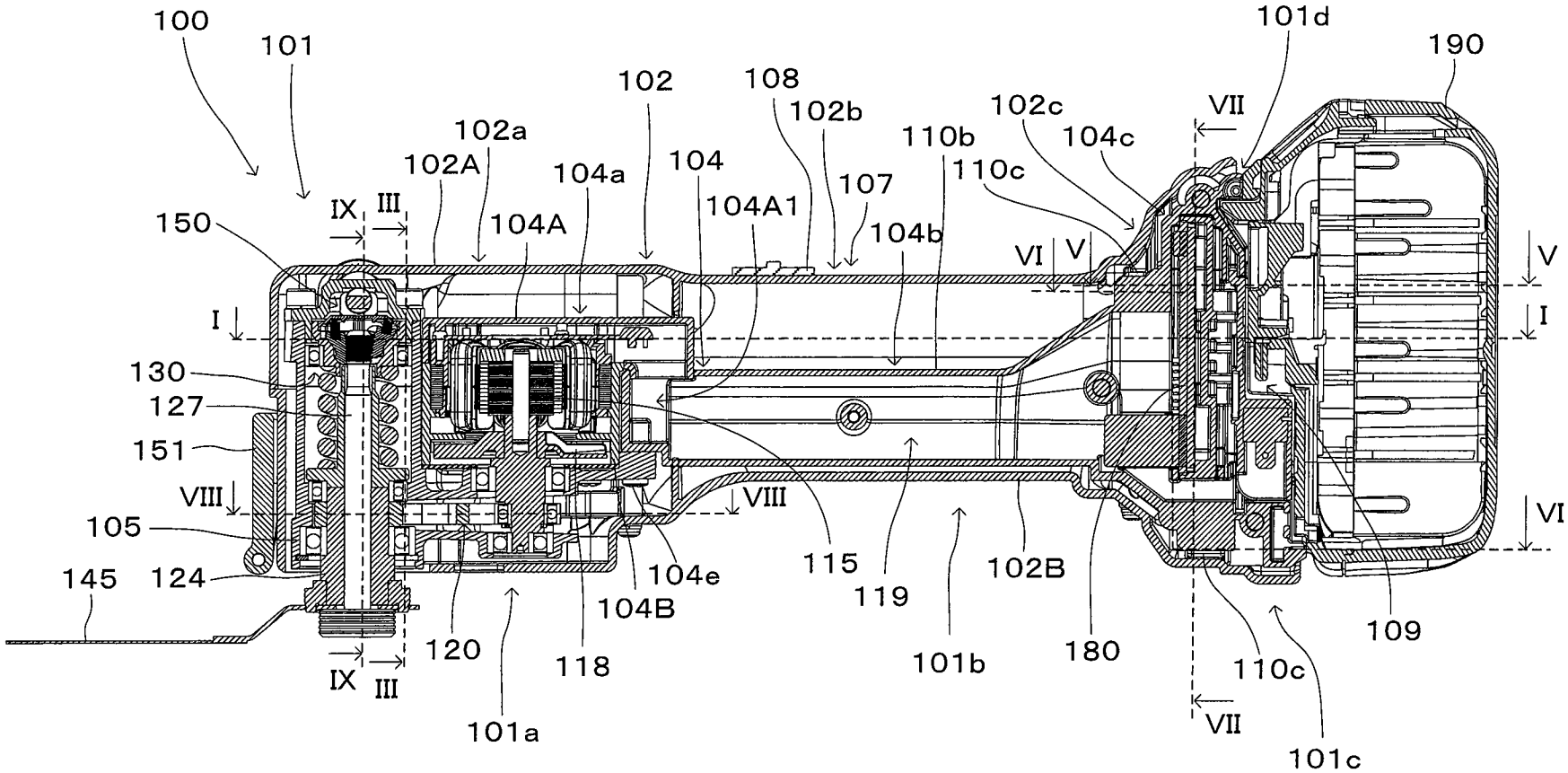
FIG. 1 is a sectional view showing an oscillating tool according to a first embodiment of the present invention.

The first embodiment of the present invention is now described with reference to FIGS. 1 to 13. In this embodiment, an electric oscillating tool 100 is described as a representative example of the work tool according to the present invention. The oscillating tool 100 is capable of selectively using plural kinds of tool accessories such as a blade and a polishing pad and performing an operation such as a cutting operation and a polishing operation corresponding to the kind of the selected tool accessory on a workpiece by oscillating the tool accessory attached to the oscillating tool 100 as shown in FIG. 1. In FIG. 1, a blade 145 is attached as a representative example of the tool accessory. The blade 145 is an example embodiment that corresponds to the "tool accessory" according to the present invention.

(Body Housing)

The oscillating tool 100 has a body housing 101 as shown in FIG. 1. The body housing 101 mainly includes an outer housing 102 and an inner housing 104 which is housed in the outer housing 102. The outer housing 102 and the inner housing 104 are example embodiments that correspond to the "outer housing" and the "inner housing", respectively, according to the present invention.

As shown in FIG. 1, the body housing 101 has an elongate form extending in a direction crossing a rotation axis of a brushless motor 115. In this embodiment, the longitudinally extending direction of the body housing 101 is defined as a longitudinal direction, and in the longitudinal direction, one side (left side as viewed in FIG. 1) on which the blade 145 is attached and the other side (right side as viewed in FIG. 1) are respectively defined as a front side and a rear side of the oscillating tool 100. An extending direction of a rotation axis of a spindle 124 described below is defined as a vertical direction, and in the vertical direction, one side (upper side as viewed in FIG. 1) on which a lock operation mechanism 150 described below is mounted and the other side (lower side as viewed in FIG. 1) on which the blade 145 is mounted are respectively defined as an upper side and a lower side of the oscillating tool 100. Further, a direction (direction of a normal to a paper plane of FIG. 1) crossing both the longitudinal direction and the vertical direction is defined as a transverse direction of the oscillating tool 100. The transverse direction corresponds to a vertical direction in FIG. 2 which is a sectional view taken along line I-I in FIG. 1 and to a horizontal direction in FIG. 6 which is a sectional view taken along line in FIG. 1. These definitions of the directions are also appropriately applied in the following descriptions relating to the other drawings and structures.

As shown in FIG. 1, the body housing 101 includes a front body housing region 101*a*, a rear body housing region 101*c* arranged on a side opposite to the front body housing region 101*a*, and an intermediate body housing region 101*b* arranged between the front body housing region 101*a* and the rear body housing region 101*c*.

As shown in FIG. 1, the outer housing 102 includes a front outer housing region 102*a*, a rear outer housing region 102*c* arranged on a side opposite to the front outer housing region 102*a*, and an intermediate outer housing region 102*b* arranged between the front outer housing region 102*a* and the rear outer housing region 102*c*. The intermediate outer housing region 102*b* forms a grip region to be held by a user. The front outer housing region 102*a*, the rear outer housing region 102*c* and the intermediate outer housing region 102*b* are example embodiments that correspond to the "front outer housing region", the "rear outer housing region" and the "intermediate outer housing region", respectively, according to the present invention.

As shown in FIG. 1, the inner housing 104 includes a front inner housing region 104*a* arranged in the front outer housing region 102*a*, an intermediate inner housing region 104*b* arranged in the intermediate outer housing region 104*b*, and a rear inner housing region 104*c* arranged in the rear outer housing region 102*c*. The front inner housing region 104*a*, the intermediate inner housing region 104*b* and the rear inner housing region 104*c* are example embodiments that correspond to the "front inner housing region", the "intermediate inner housing region" and the "rear inner housing region", respectively, according to the present invention.

Figure 2:
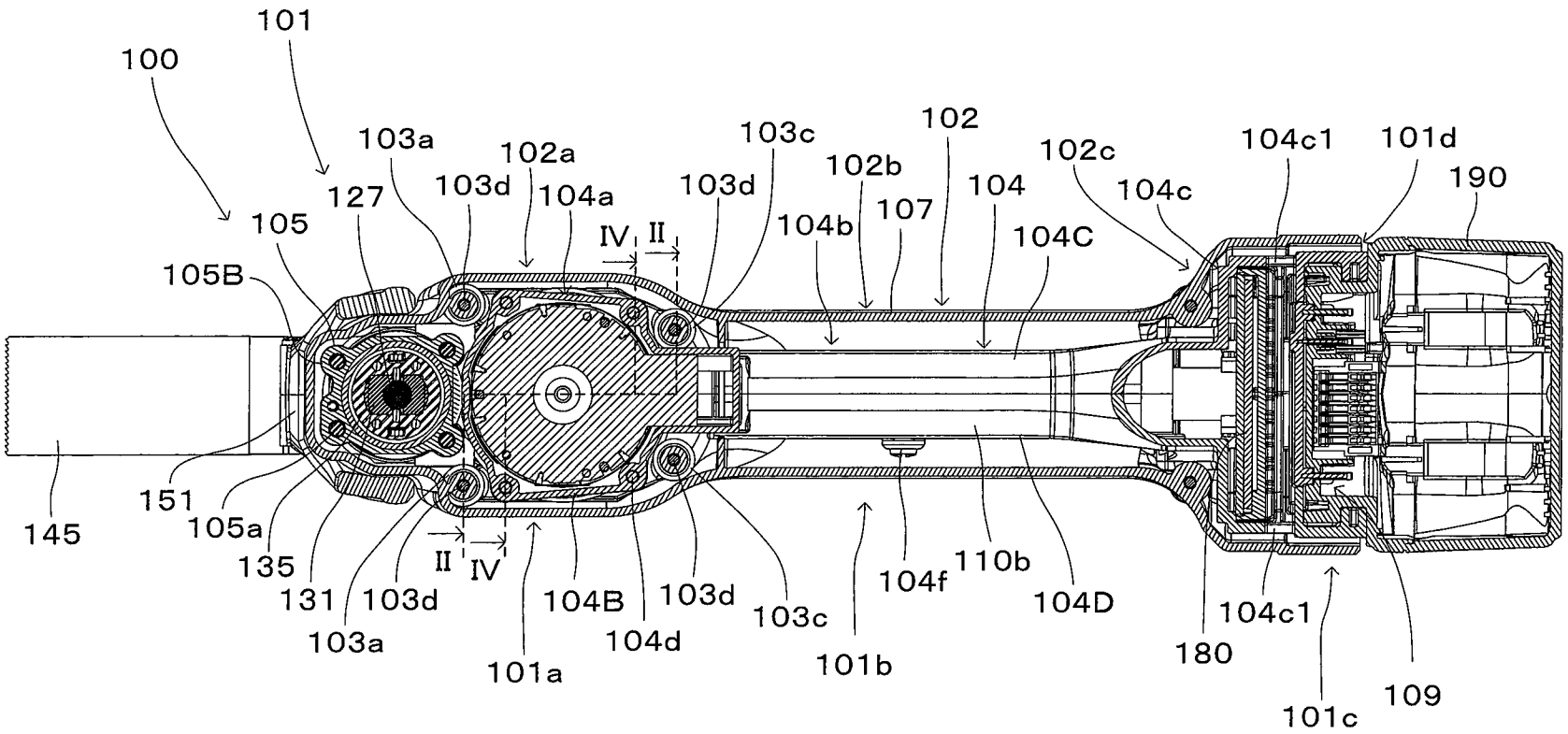
FIG. 2 is sectional view showing the structure of a body housing.

FIG. 2 is a sectional view taken along line I-I in FIG. 1. As shown in FIG. 2, the intermediate outer housing region 102*b* has a thin part 107 having a smaller width than the front and rear outer housing regions 102*a*, 102*c* in the transverse direction.

In the oscillating tool 100, as described below, the brushless motor 115 is housed in the front inner housing region 104*a*, and a controller 180 is housed in the rear inner housing region 104*c*. Thus, such parts having a relatively large width in the transverse direction are respectively arranged in the front inner housing region 104*a* and the rear inner housing region 104*c*, so that the thin part 107 is formed in the intermediate outer housing region 102*b*. The thin part 107 is dimensioned to fit well to a hand of a user who uses the intermediate outer housing region 102*b* as a grip. The thin part 107 is an example embodiment that corresponds to the "thin part" according to the present invention.

As shown in FIG. 1, a slide switch 108 which is operated by a user is arranged on the thin part 107. The slide switch 108 and a battery mounting part 109 are electrically connected to the controller 180. Thus, the brushless motor 115 is turned on and off by operating the slide switch 108. The controller 180 is formed by arranging a switching element for controlling a plurality of coils of the brushless motor 115, a central processing unit (CPU) and a capacitor on a substrate. The controller 180 controls driving of the brushless motor 115 based on operation of the slide switch 108. The brushless motor 115 is an example embodiment that corresponds to the "brushless motor" according to the present invention.

Figure 3:
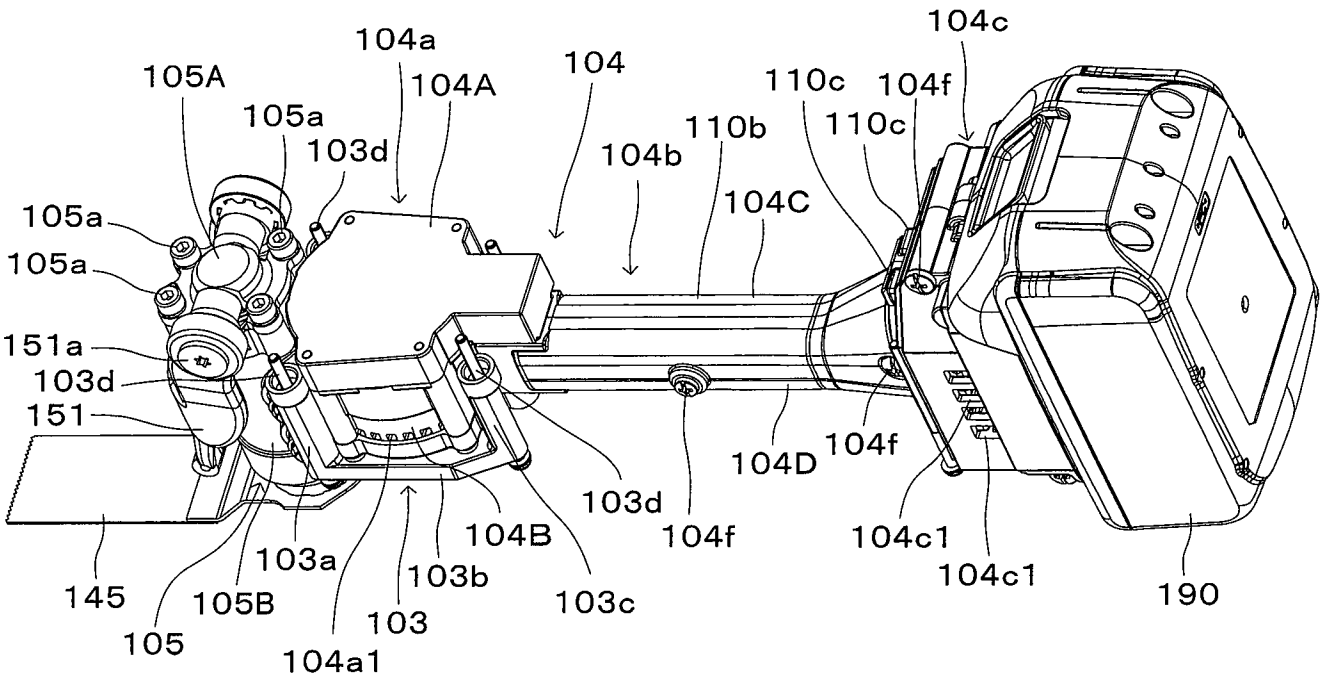
FIG. 3 is a perspective view showing the structures of an inner housing and an intervening member.
Figure 4:
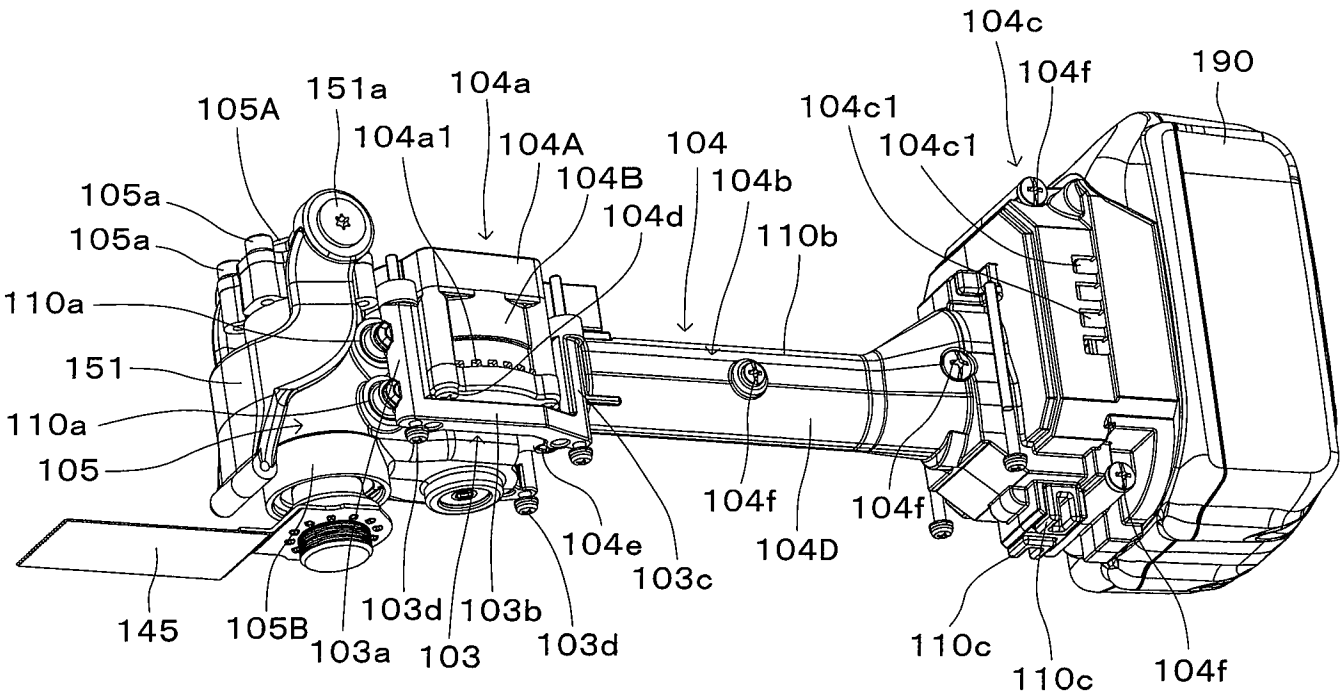
FIG. 4 is a perspective view showing the structures of the inner housing and the intervening member.
Figure 5:
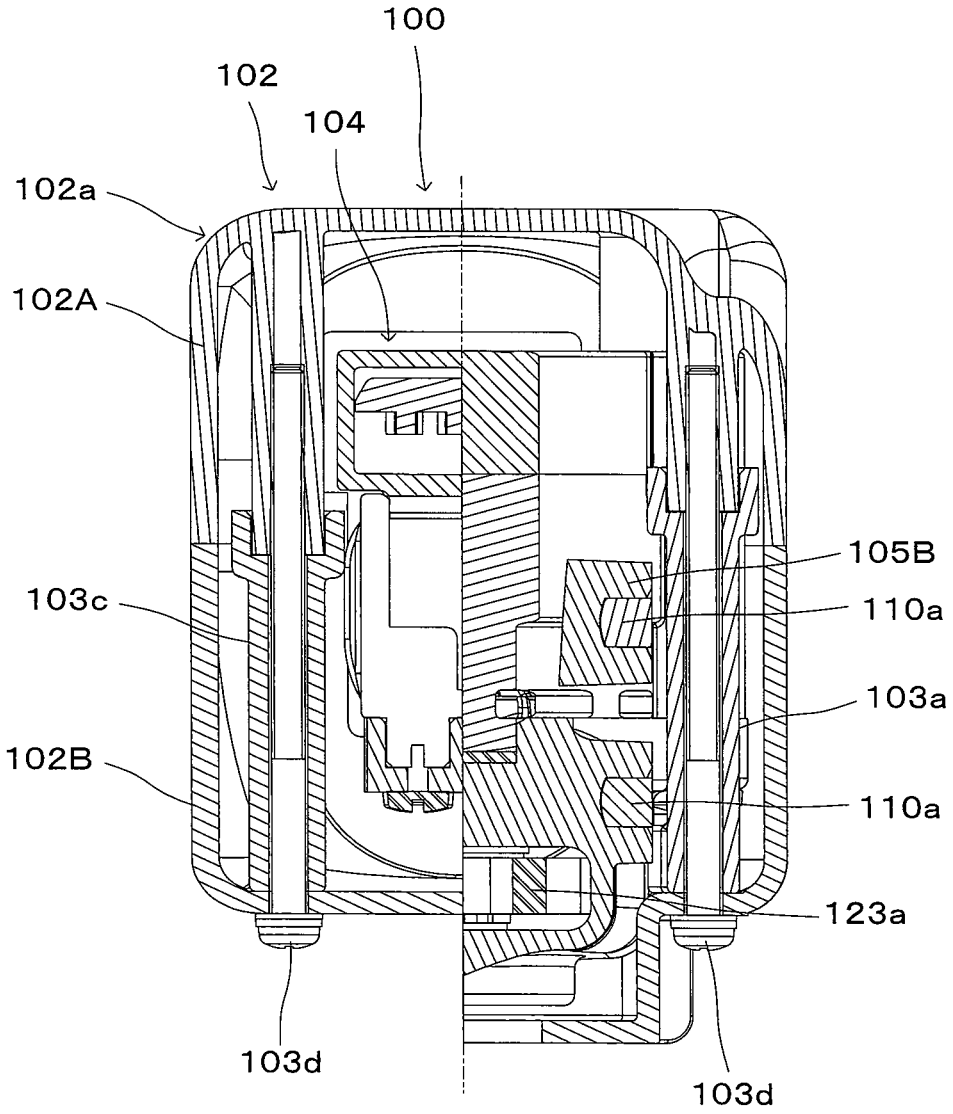
FIG. 5 is a sectional view showing the structures of an outer housing and the intervening member.
Figure 6:
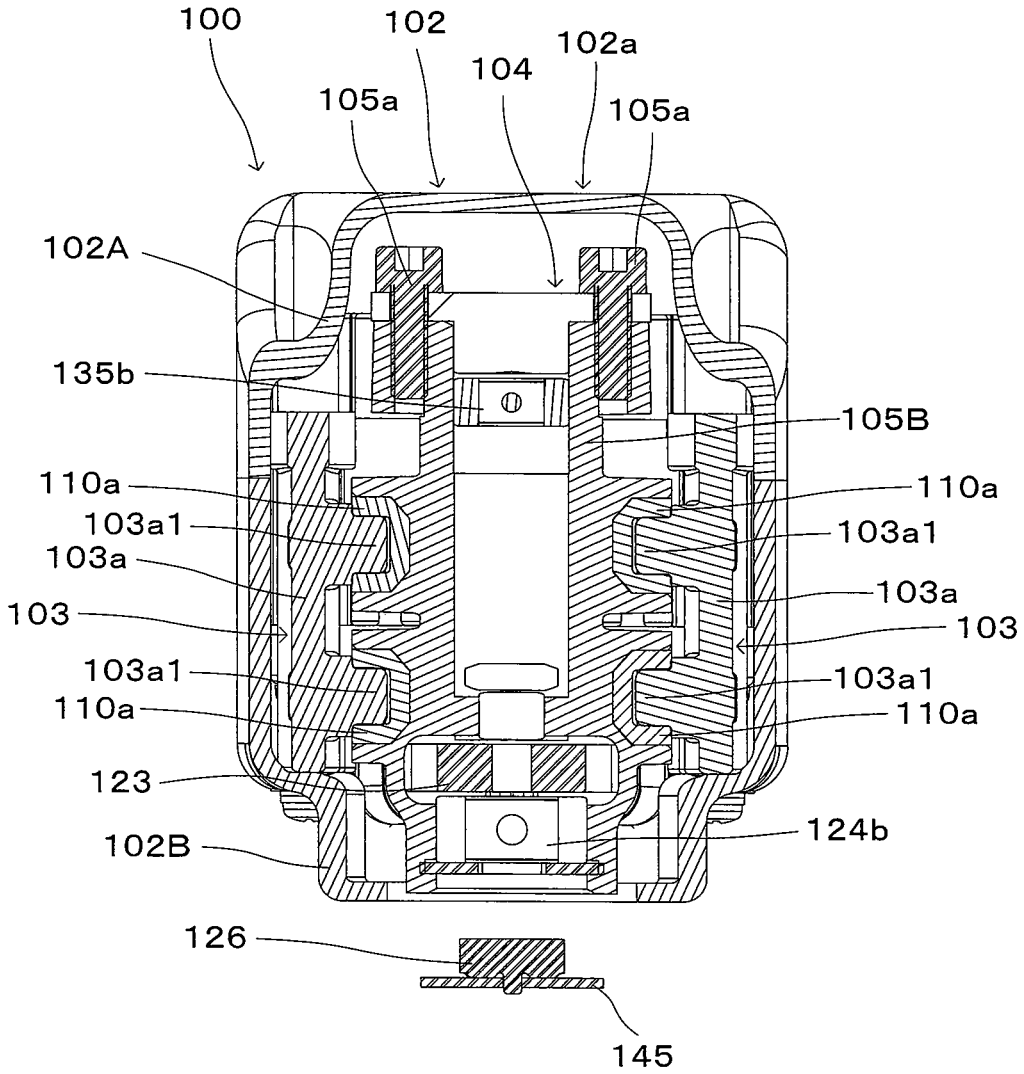
FIG. 6 is a sectional view showing the structure of a front elastic member.

FIGS. 2 to 6 respectively show part of the structures relating to the body housing 101. FIGS. 3 and 4 are perspective views showing the structures of the inner housing 104 and an intervening member 103. FIG. 5 is a sectional view taken along line II-II in FIG. 2, and FIG. 6 is a sectional view taken along line in FIG. 1.

As shown in FIGS. 1, 5 and 6, the outer housing 102 mainly includes a first outer housing 102A arranged on the upper side and a second outer housing 102B arranged on the lower side. The first outer housing 102A and the second outer housing 102B are formed of synthetic resin.

The intervening member 103 which is integrally connected to the outer housing 102 is shown in FIGS. 2 to 6. Particularly, the overall structure of the intervening member 103 is shown in FIGS. 3 and 4. The intervening member 103 is formed of synthetic resin.

As shown in FIGS. 2, 5 and 6, two such intervening members 103 are provided and spaced apart from each other in the transverse direction. The intervening members 103 are integrally connected to the first and second outer housings 102A, 102B by fastening members 103*d* as shown in FIG. 5. The fastening members 103*d* are screws. As shown in FIGS. 3 and 4, each of the intervening members 103 has a front intervening member region 103*a* and a rear intervening member region 103*c* which extend in the vertical direction, and an intermediate intervening member region 103*b* extending between the front and rear intervening member regions 103*a*, 103*c*. As shown in FIG. 6, the front intervening member region 103*a* has a plurality of projections 103*a*1 protruding inward.

As shown in FIGS. 3 and 4, the inner housing 104 is formed by integrally connecting a driving mechanism housing 105, a first inner housing 104A, a second inner housing 104B, a third inner housing 104C and a fourth inner housing 104D. The driving mechanism housing 105 is formed of metal, and the first to fourth inner housings 104A, 104B, 104C, 104D are formed of synthetic resin. As shown in FIG. 1, the driving mechanism housing 105 houses a driving mechanism 120 which drives the blade 145 by the output of the brushless motor 115.

Figure 7:
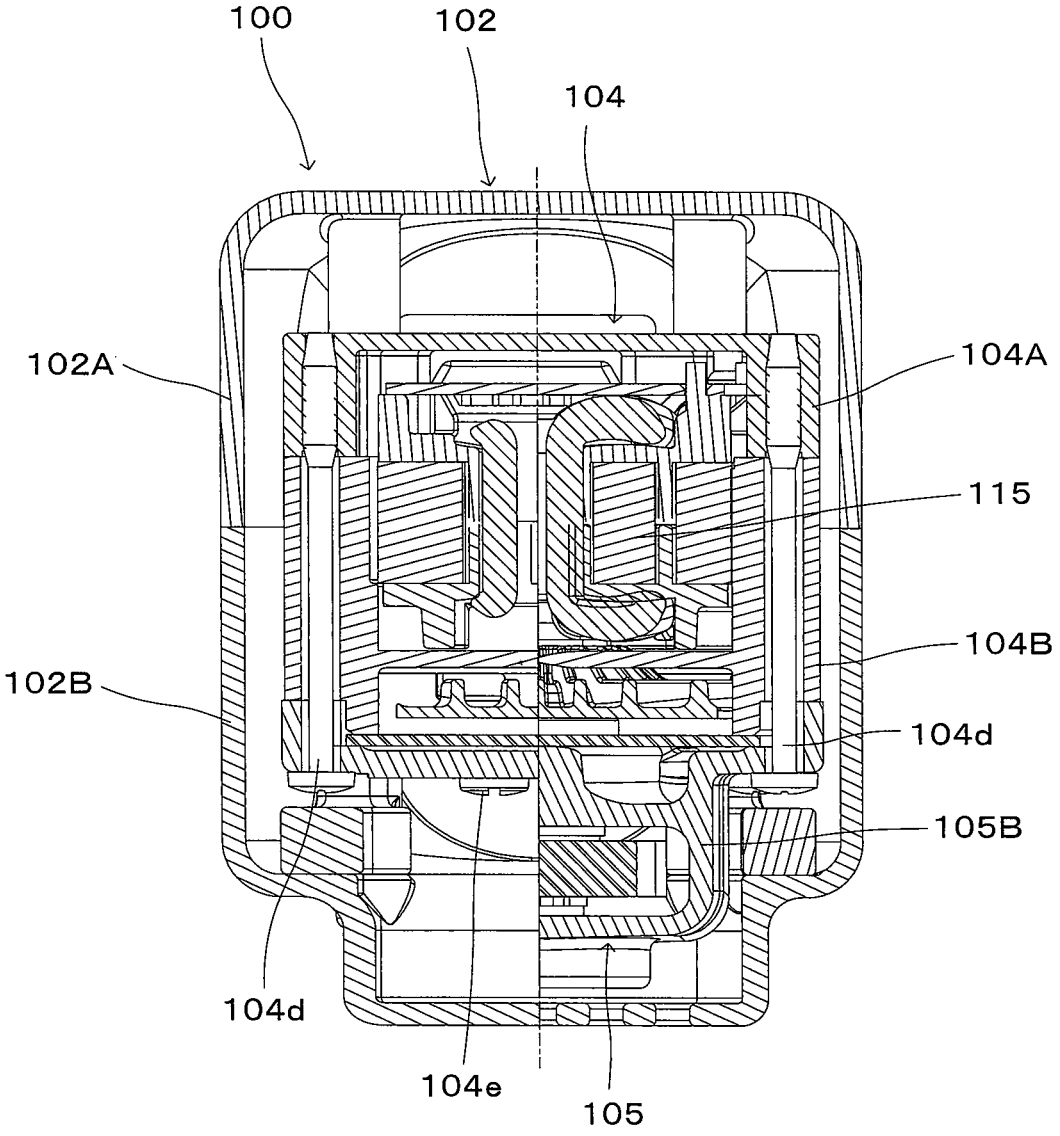
FIG. 7 is a sectional view showing the structure of the inner housing and a driving mechanism housing.

FIG. 7 is a sectional view taken along line IV-IV in FIG. 2. As shown in FIG. 7, the first inner housing 104A and the second inner housing 104B house the brushless motor 115 and are integrally connected to the driving mechanism housing 105 by fastening members 104*d*. The fastening members 104*d* are screws. The front inner housing region 104*a* mainly includes the driving mechanism housing 105, the first inner housing 104A and the second inner housing 104B.

The intermediate inner housing region 104*b* and the rear inner housing region 104*c* are hollow as shown in FIG. 1 and mainly include the third inner housing 104C and the fourth inner housing 104D as shown in FIGS. 2 to 4. The third inner housing 104C and the fourth inner housing 104D are arranged adjacent to each other in the transverse direction and integrally connected by fastening members 104*f* or screws. The third inner housing 104C and the driving mechanism housing 105 are integrally connected by a fastening member 104*e* shown in FIGS. 1 and 7. The fastening member 104*e* is a screw. Further, as shown in FIG. 1, a rear end of the second inner housing 104B and front ends of the third and fourth inner housings 104C, 104D are held in contact with each other. With this structure, the driving mechanism housing 105 and the first to fourth inner housings 104A, 104B, 104C, 104D are integrated together.

As shown in FIGS. 1 and 2, an enlarged diameter region is formed in rear regions of the third and fourth inner housings 104C, 104D. The enlarged diameter region forms the rear inner housing region 104*c*. In the rear inner housing region 104*c*, the controller 180 is disposed and the battery mounting part 109 for mounting a battery 190 is formed. The battery 190 and the battery mounting part 109 are example embodiments that correspond to the "battery" and the "battery mounting part", respectively, according to the present invention. The battery mounting part 109 has a power receiving terminal which is electrically connected to a power feeding terminal of the battery 190. The battery mounting part 109 is configured such that the battery 190 can be removably mounted by sliding the battery 190 in the vertical direction. Further, as shown in FIG. 1, the controller 180 is arranged to extend in the sliding direction (the vertical direction) in which the battery 190 is slid to be mounted to the battery mounting part 109. With this structure, a rear body housing region 101*c* can be shortened in the longitudinal direction.

As shown in FIGS. 2 to 4, inlets 104*c*1 are formed in the rear inner housing region 104*c*. The inlets 104*c*1 are formed in both the third and fourth inner housings 104C, 104D. The controller 180 is arranged immediately downstream of the inlets 104*c*1. As shown in FIGS. 3 and 4, outlets 104*a*1 are formed in the second inner housing 104B. An internal space (space part) of the intermediate inner housing region 104*b* forms an air passage 119 which provides communication between the inlets 104*c*1 and the outlets 104*a*1. When a cooling fan 118 (see FIG. 1) mounted on an output shaft 115*a* of the brushless motor 115 is rotationally driven, outside air is sucked in from the inlets 104*c*1 and discharged to the outside from the outlets 104*a*1 via the air passage 119. By this air flow, the controller 180 and the brushless motor 115 are efficiently cooled. The inlet 104*c*1, the outlet 104*a*1, the cooling fan 118 and the air passage 119 are example embodiments that correspond to the "inlet", the "outlet", the "cooling fan" and the "air passage", respectively, according to the present invention.

Further, as shown in FIG. 1, a gap is formed between the rear outer housing region 102*c* and the rear inner housing region 104*c* and forms a body inlet 101*d*. With this structure, air which is caused to flow by rotational driving of the cooling fan 118 is led from the body inlet 101*d* to the inlets 104*c*1.

Further, a connecting part (not shown) for electrically connecting the brushless motor 115 and the controller 180 is provided in the air passage 119. The connecting part includes a feeding cable and a signal transmitting cable. The internal space of the body housing 101 can be efficiently used by arranging the connecting part in the air passage 119. The connecting part is an example embodiment that corresponds to the "connecting part" according to the present invention.

(Elastic Members)

The outer housing 102 and the inner housing 104 are connected by elastic members. This structure prevents vibration of the inner housing 104 from being transmitted to the outer housing 102. The elastic members include a front elastic member 110*a*, an intermediate elastic member 110*b* and a rear elastic member 110*c*.

As shown in FIG. 6, four front elastic members 110*a* are arranged between the projections 103*a*1 of the front intervening member region 103*a* and the driving mechanism housing 105. The four front elastic members 110*a* form pair groups of vertically spaced members and pair groups of transversely spaced members. As described above, the driving mechanism housing 105 forms the inner housing 104 and the intervening member 103 is integrally connected to the outer housing 102. Therefore, the front outer housing region 102*a* and the front inner housing region 104*a* are connected via the front elastic members 110*a*. The front elastic member 110*a* is an example embodiment that corresponds to the "front elastic member" according to the present invention. The front elastic members 110*a* are rubber elastic elements and are arranged to cover the respective projections 103*a*1. The driving mechanism housing 105 has recesses in which the projections 103*a*1 covered by the front elastic members 110*a* are fitted. With this structure, the front elastic members 110*a* are disposed between the front outer housing region 102*a* and the front inner housing region 104*a* in the longitudinal, vertical and transverse directions. Therefore, transmission of vibration from the front inner housing region 104*a* to the front outer housing region 102*a* is effectively prevented or reduced in all directions.

Figure 8:
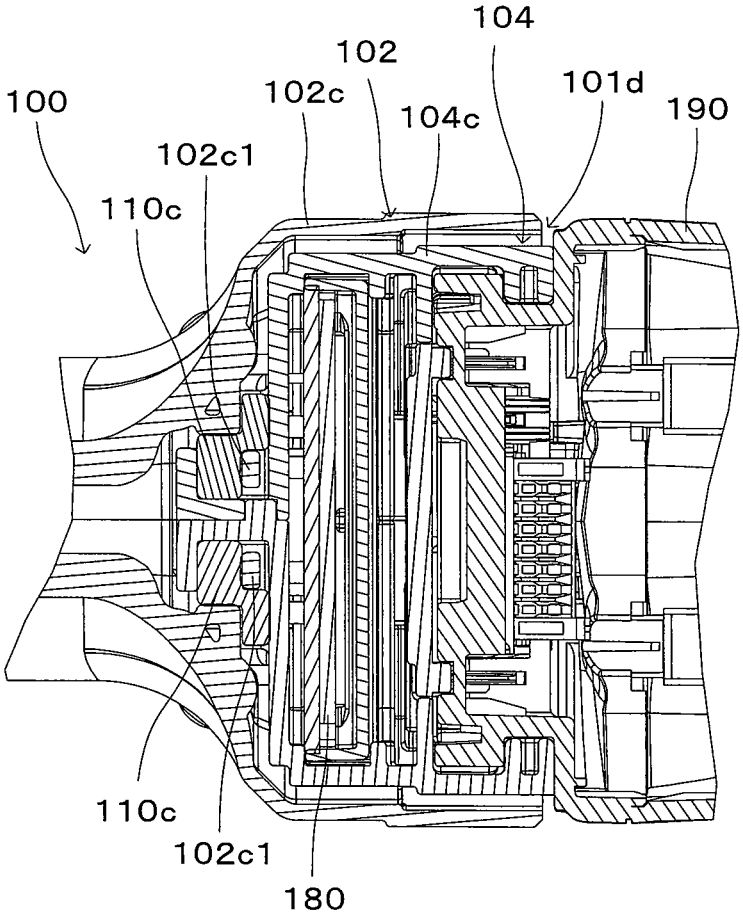
FIG. 8 is a sectional view showing the structure of an upper rear elastic member.
Figure 9:
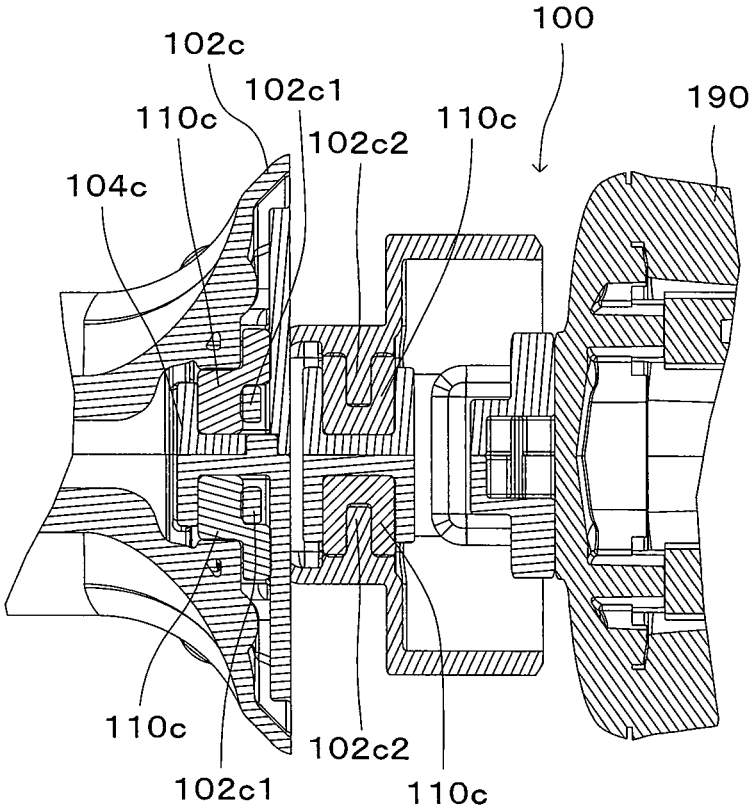
FIG. 9 is a sectional view showing the structures of upper and lower rear elastic members.

As shown in FIGS. 3, 4, 8 and 9, four rear elastic members 110*c* are disposed between the rear inner housing region 104*c* and the rear outer housing region 102*c*. FIG. 8 is a sectional view taken along line V-V in FIG. 1, and FIG. 9 is a sectional view taken along line VI-VI in FIG. 1. The four rear elastic members 110*c* form pair groups of vertically spaced members and pair groups of transversely spaced members. The rear elastic member 110*c* is an example embodiment that corresponds to the "rear elastic member" according to the present invention. The rear elastic members 110*c* are rubber elastic elements.

As shown in FIGS. 3, 8 and 9, the upper rear elastic member 110*c* in each pair group of the vertically spaced members is disposed in a space between the rear inner housing region 104*c* and the rear outer housing region 102*c*. This space is partly defined by a projection 102*c*1 formed on the rear outer housing region 102*c*. The upper rear elastic member 110*c* is configured to extend in the longitudinal, vertical and transverse directions.

Figure 10:
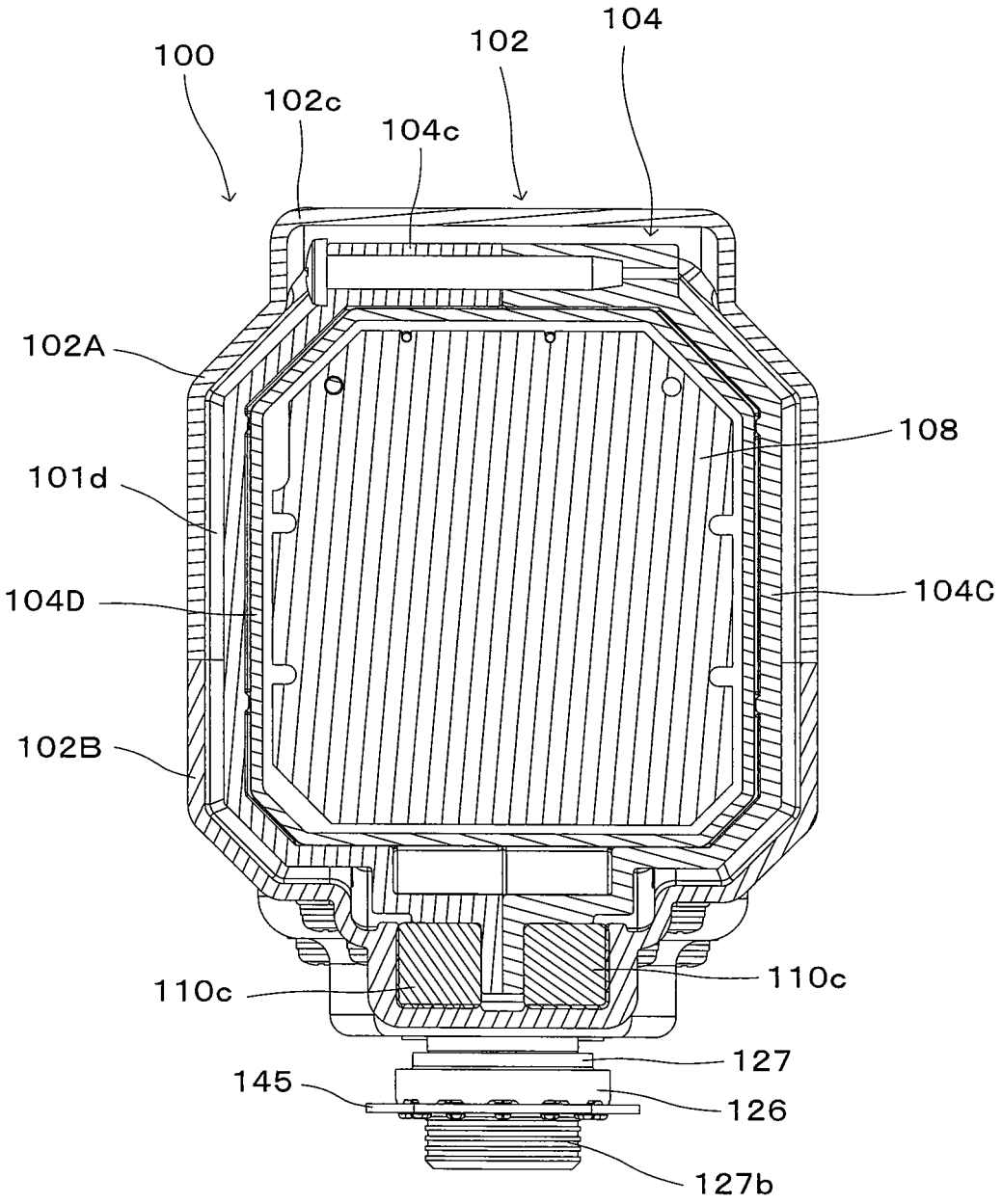
FIG. 10 is a sectional view showing the structure of the lower rear elastic member.

Further, as shown in FIGS. 4, 9 and 10, the lower rear elastic member 110*c* in each pair group of the vertically spaced members is disposed in a space between the rear inner housing region 104*c* and the rear outer housing region 102*c*. This space is partly defined by a projection 102*c*2 formed on the rear outer housing region 102*c*. The lower rear elastic member 110*c* is configured to extend in the longitudinal, vertical and transverse directions.

With this structure, the rear elastic members 110*c* are disposed between the rear inner housing region 104*c* and the rear outer housing region 102*c* in the longitudinal, vertical and transverse directions. Therefore, transmission of vibration from the rear inner housing region 104*c* to the rear outer housing region 102*c* is effectively prevented or reduced in all directions.

As an alternative to the above-described arrangement, the rear elastic members 110*c* may be disposed at a boundary between the rear inner housing region 104*c* and the intermediate inner housing region 104*b* and a boundary between the rear outer housing region 102*c* and the intermediate outer housing region 102*b*. Further, the rear elastic members 110*c* may be disposed between the intermediate inner housing region 104*b* and the intermediate outer housing region 102*b*.

The intermediate inner housing region 104*b* shown in FIGS. 2 to 4 is formed of synthetic resin so as to be imparted with flexibility. Thus, the intermediate inner housing region 104*b* is configured to serve as the intermediate elastic member 110*b* as well. The intermediate elastic member 110*b* is an example embodiment that corresponds to the "intermediate elastic member" according to the present invention. The intermediate elastic member 110*b* extends in the longitudinal direction and can deform around its longitudinally extending axis. Therefore, transmission of vibration from the front inner housing region 104*a* to the rear inner housing region 104*c* is effectively prevented or reduced.

(Driving Mechanism)

Figure 11:
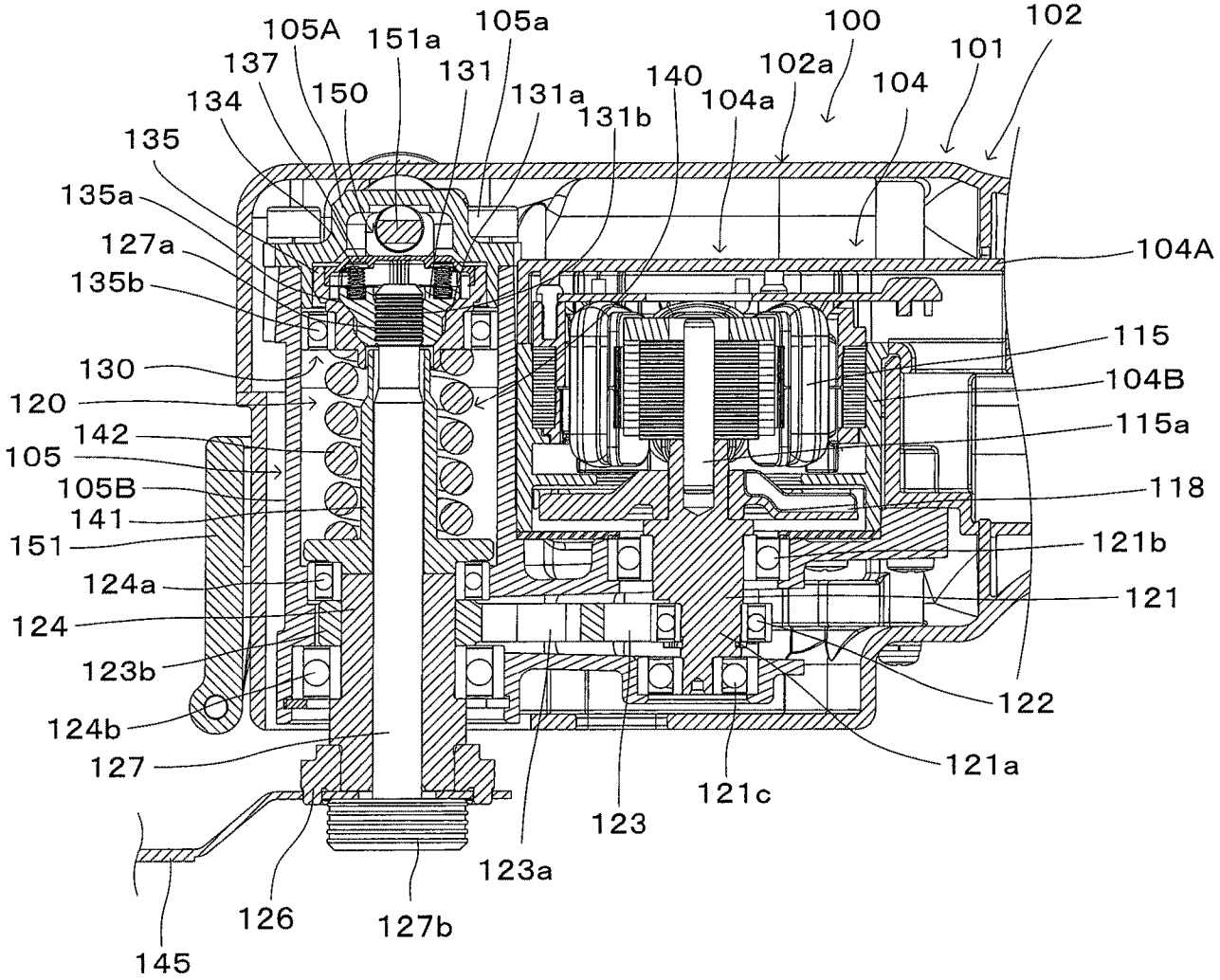
FIG. 11 is a sectional view showing the structure of the driving mechanism.
Figure 12:
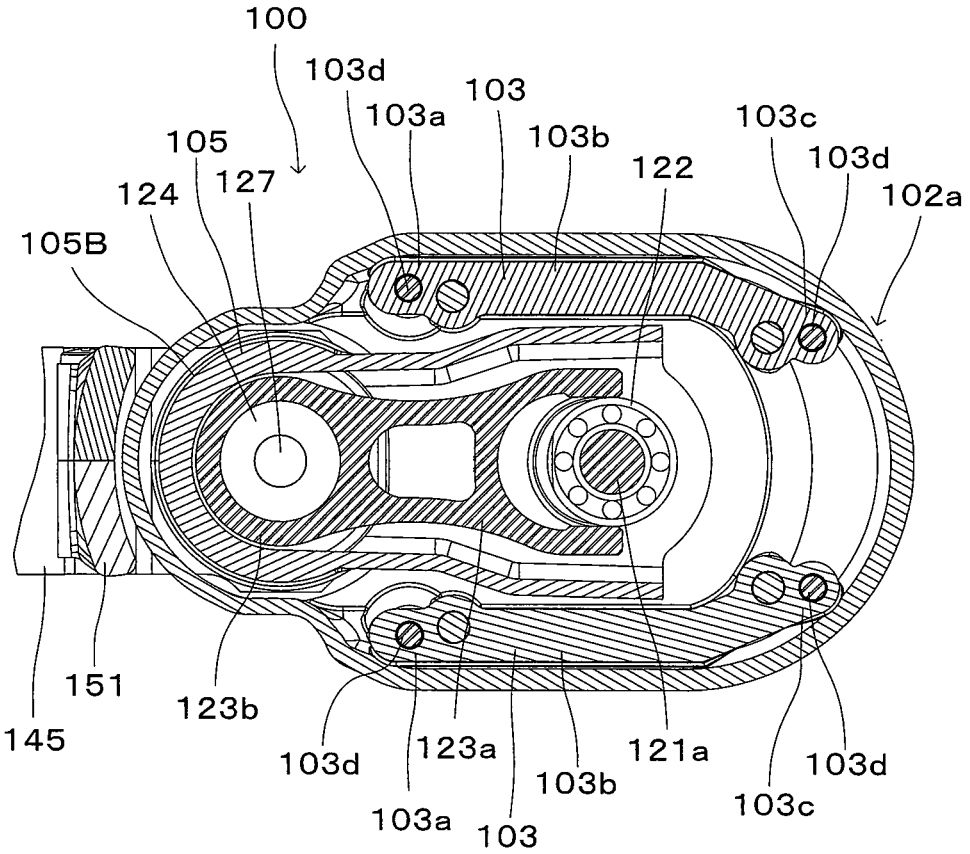
FIG. 12 is a sectional view showing the structure of a driven arm.
Figure 13:
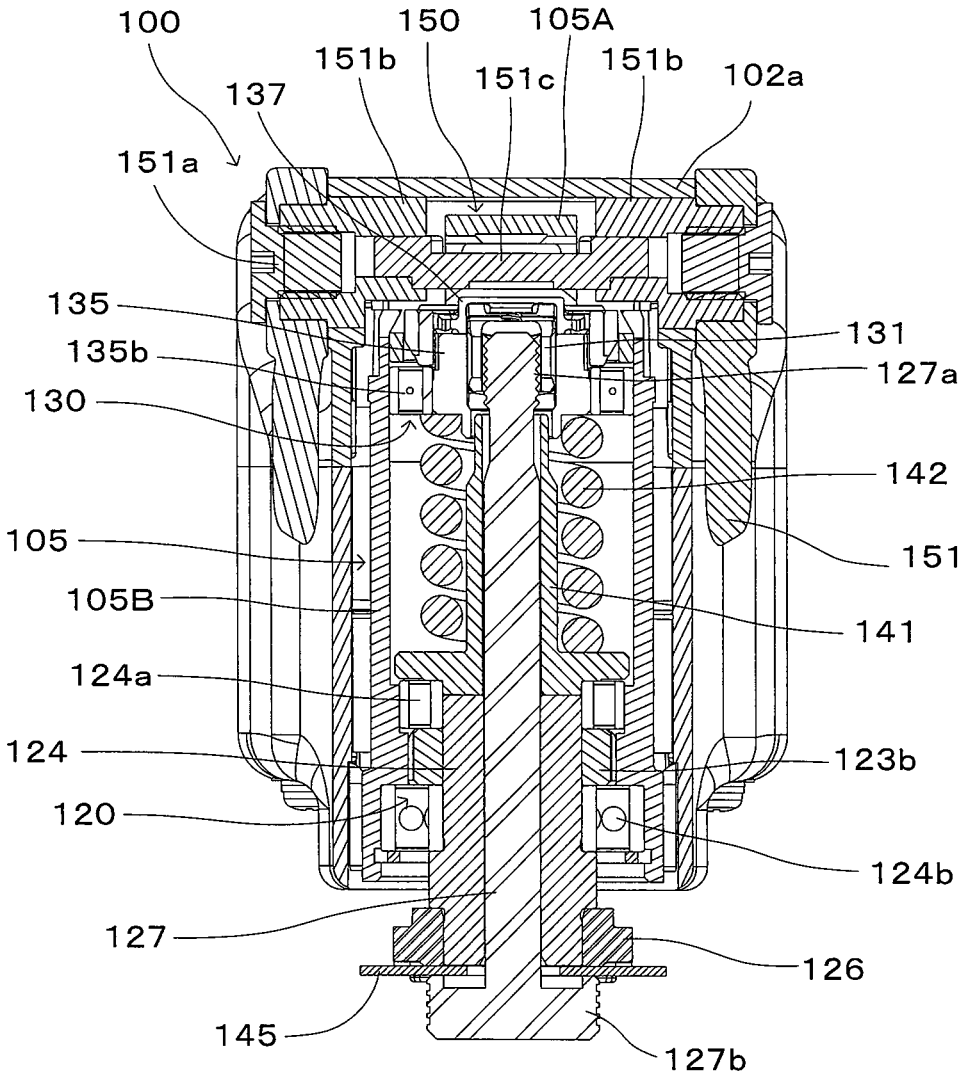
FIG. 13 is a sectional view showing the structure of a lock operation mechanism.

The structure of the driving mechanism 120 is now described with reference to FIGS. 1, 11 to 13. FIG. 11 is an enlarged sectional view showing the driving mechanism 120. FIG. 12 is a sectional view taken along line in FIG. 1. FIG. 13 is a sectional view taken along line IX-IX in FIG. 1.

As shown in FIGS. 1 and 11, the driving mechanism 12 mainly includes an eccentric shaft 121, a drive bearing 122, a driven arm 123 and a spindle 124. The spindle 124 is an example embodiment that corresponds to the "spindle" according to the present invention. The spindle 124 is cylindrically formed, and a clamp shaft 127 is removably fitted in the spindle 124. The oscillating tool 100 has a lock mechanism 130 for locking and unlocking the clamp shaft 127 with respect to the oscillating tool 100, and a lock operation mechanism 150 with which the lock mechanism 130 is manually operated by a user.

As shown in FIG. 11, the driving mechanism housing 105 has a first driving mechanism housing 105A and a second driving mechanism housing 105B, and the driving mechanism 120, the lock mechanism 130 and the lock operation mechanism 150 are disposed between the first driving mechanism housing 105A and the second driving mechanism housing 105B. The first driving mechanism housing 105A and the second driving mechanism housing 105B are integrally connected by fastening members 105*a*. The fastening members 105*a* are screws.

As shown in FIG. 11, the direction of a rotation axis of the spindle 124 is parallel to the output shaft 115*a* of the brushless motor 115. The eccentric shaft 121 is mounted onto an end of the output shaft 115*a* of the brushless motor 115 and rotatably supported by an upper bearing 121*b* and a lower bearing 121*c*. The bearings 121*b*, 121*c* are held by the driving mechanism housing 105.

As shown in FIGS. 11 and 12, the driven arm 123 has an arm part 123*a* and a fixed part 123*b*. The arm part 123*a* is configured to be held in contact with the outer periphery of the drive bearing 122 mounted on an eccentric part 121*a* of the eccentric shaft 121. The fixed part 123*b* is configured to surround a prescribed region of the spindle 124 and fixed to the spindle 124. The driven arm 123 and the spindle 124 are arranged below the brushless motor 115. With this structure, the spindle 124 can be shortened in the vertical direction. Further, with this structure, the blade 145 can be arranged closer to the driven arm 123 in the vertical direction. Therefore, a couple of force which is generated according to the distance between the driven arm 123 and the blade 145 is reduced. Thus, vibration which is caused by machining the workpiece with the blade 145 is reduced.

As shown in FIG. 11, the spindle 124 has a flange-like tool holding part 126 for holding the blade 145 in cooperation with the clamp shaft 127. The spindle 124 is rotatably supported by an upper bearing 124*a* and a lower bearing 124*b*.

The clamp shaft 127 is a generally columnar member configured to be inserted through the spindle 124 as shown in FIG. 11. The clamp shaft 127 has an upper end part having an engagement groove part 127*a* and a lower end part having a flange-like clamp head 127*b*. When the clamp shaft 127 is inserted through the spindle 124 and the engagement groove part 127*a* is held by the lock mechanism 130, the blade 145 is held between the clamp head 127*b* and the tool holding part 126.

When the brushless motor 115 is driven and the output shaft 115*a* is rotated, the eccentric part 121*a* of the eccentric shaft 121 and the drive bearing 122 rotate around the motor rotation axis. Thus, the driven arm 123 is driven to swing on the rotation axis of the spindle 124. As a result, the blade 145 held between the spindle 124 and the clamp shaft 127 is driven to swing to perform a prescribed operation (such as a cutting operation).

(Lock Mechanism)

The lock mechanism 130 shown in FIG. 11 serves to hold the clamp shaft 127

As shown in FIG. 11, the lock mechanism 130 mainly includes a clamp member 131, a collar member 135, a first coil spring 134, a lid member 137 and a bearing 135*b*. These components of the lock mechanism 130 form a lock mechanism assembly. Further, the lock mechanism 130 has a biasing mechanism 140 which biases the clamp shaft 127 upward. The biasing mechanism 140 mainly includes a support member 141 and a second coil spring 142.

As shown in FIG. 11, the support member 141 has a generally cylindrical hollow shape through which the clamp shaft 127 is inserted. The support member 141 is rotatably supported by the bearing 124*a*. The bearing 124*a* is configured to support both the spindle 124 and the support member 141. With this structure, the number of bearings can be reduced, and the oscillating tool 100 can be shortened in the vertical direction. The support member 141 is inserted through the second coil spring 142. The support member 141 has a flange-like lower part configured to be held in contact with a lower end of the second coil spring 142. Further, the support member 141 has an upper end configured to support the clamp member 131 when the clamp member 131 is placed in a position (disengaging position) for replacement of the blade 145.

As shown in FIG. 11, the lock mechanism 130 is disposed between the upper end of the support member 141 and the first driving mechanism housing 105A in the direction of the rotation axis of the spindle 124. The lock mechanism 130 and the spindle 124 are configured independently and arranged apart from each other, so that the lock mechanism 130 can be designed without depending on the design of the spindle 124.

As shown in FIG. 11, the clamp member 131 consists of a pair of members which hold the engagement groove part 127*a* of the clamp shaft 127 in a radial direction of the clamp shaft 127. Each clamp member 131 is configured to be movable in a direction crossing the vertical direction. Further, a plurality of ridge parts are formed on an inner surface region of the clamp member 131 facing the clamp shaft 127 and can engage with the engagement groove part 127*a* of the clamp shaft 127. Further, as shown in FIG. 11, the clamp member 131 has two clamp member inclined parts 131*a* inclined with respect to the vertical direction.

As shown in FIG. 11, the first coil spring 134 is disposed between each of the clamp members 131 and the lid member 137. The first coil spring 134 biases the clamp member 131 downward so as to stabilize the attitude of the clamp member 131.

As shown in FIG. 11, the collar member 135 serves to control clamping of the clamp shaft 127 by the clamp members 131. The collar member 135 has a hole in which the clamp members 131 are disposed and through which the clamp shaft 127 is inserted. The bearing 135*b* for rotatably supporting the collar member 135 is disposed in an outside region of the collar member 135. The bearing 135*b* is configured to be slidable with respect to the second driving mechanism housing 105B.

With this structure, the lock mechanism assembly is allowed to move in the direction of the rotation axis of the spindle 124. The collar member 135 has two collar member inclined parts 135*a* inclined with respect to the rotation axis direction of the spindle 124. The collar member inclined parts 135*a* and the clamp member inclined parts 131*a* are configured to slide in contact with each other. Therefore, the same number of the clamp member inclined parts 131*a* as the collar member inclined parts 135*a* are provided.

As shown in FIG. 11, the collar member 135 is biased by the second coil spring 142 and the clamp member 131 is biased by the first coil spring 134, so that the collar member inclined parts 135*a* come in contact with the clamp member inclined parts 131*a*. Thus, the clamp member 131 is moved inward in the radial direction of the clamp shaft 127. As a result, the two clamp members 131 hold the clamp shaft 127 while the ridge parts of the clamp members 131 are engaged with the engagement groove part 127*a* of the clamp shaft 127. The clamp shaft 127 is held between the clamp members 131 and biased upward by the second coil spring 142. In this manner, the blade 145 is held between the clamp head 127*b* of the clamp shaft 127 and the tool holding part 126 of the spindle 124.

(Lock Operation Mechanism)

The lock operation mechanism 150 shown in FIGS. 11 and 13 is configured to operate the lock mechanism 130. More specifically, the lock operation mechanism 150 is configured to move the collar member 135 in the vertical direction. By the movement of the collar member 135 in the vertical direction, the clamp member 131 is switched to be engaged with and disengaged from the clamp shaft 127.

As shown in FIGS. 11 and 13, the lock operation mechanism 150 mainly includes a handle part 151 which is operated by a user and a pivot shaft 151*a* which is interlocked with the handle part 151. As shown in FIG. 13, the pivot shaft 151*a* is arranged to extend through the driving mechanism housing 105 between the lid member 137 and the first driving mechanism housing 105A. A pair of cams 151*b* are provided on both ends of the pivot shaft 151*a* and configured to come in contact with the collar member 135. An eccentric shaft 151*c* is provided between the cams 151*b*.

FIGS. 11 and 13 show the state in which the blade 145 is attached to the oscillating tool 100. The cams 151*b* are configured not to come in contact with the collar member 135 in this state. In this state, the collar member 135 is biased upward by the second coil spring 142, and the collar member inclined parts 135*a* come in contact with the clamp member inclined parts 131*a*. As a result, the two clamp members 131 are moved toward the clamp shaft 127 and hold the clamp shaft 127. Further, the eccentric shaft 151*c* is placed apart from the first driving mechanism housing 105A. The upper end of the support member 141 is held in non-contact with the clamp members 131.

As described above, in this state, the position of the clamp shaft 127 defines a holding position for holding the blade 145, the position of the clamp member 131 defines an engaging position for engaging with the clamp shaft 127, and the position of the collar member 135 defines a maintaining position for maintaining the clamp member 131 in the engaging position.

In order to remove the blade 145 from the oscillating tool 100, the user turns the handle part 151, so that the pivot shaft 151*a* is rotated. In this state, the cams 151*b* come into contact with the collar member 135 and move the collar member 135 downward against the biasing force of the second coil spring 142. As a result, the upper end of the support member 141 comes into contact with the clamp members 131 and the clamp members 131 are moved upward with respect to the collar member 135.

When the clamp members 131 are moved upward with respect to the collar member 135, the clamp member inclined parts 131*a* are disengaged from the collar member inclined parts 135*a*, so that the clamp members 131 are allowed to move in a direction away from the clamp shaft 127. Specifically, the force of clamping the clamp shaft 127 with the clamp members 131 is reduced. In this state, the clamp shaft 127 can be pulled out downward and removed from the spindle 124. By thus releasing the clamp shaft 127, the blade 145 is also released, so that the tool accessory or blade 145 can be replaced.

In this state, the position of the collar member 135 defines an allowing position for allowing the clamp member 131 to move to a disengaging position, the position of the clamp member 131 defines the disengaging position for disengaging from the clamp shaft 127, and the position of the clamp shaft 127 defines a releasing position for releasing the blade 145.

Further, the eccentric shaft 151*c* is placed in contact with the first driving mechanism housing 105A.

(Operation for Machining)

Operation of the oscillating tool 100 for machining is now described with reference to FIGS. 1, 2 and 11. When a user holds the thin part 107 of the intermediate outer housing region 102*b* and turns on the slide switch 108, the controller 180 rotationally drives the brushless motor 115. Thus, the drive bearing 122 is rotated together with the eccentric shaft 121. As a result, the drive bearing 122 drives the driven arm 123, so that the blade 145 swings on the rotation axis of the spindle 124 together with the spindle 124. In this state, machining operation can be performed when the blade 145 is placed in contact with a workpiece by the user.

In machining, due to the structure in which the rear inner housing region 104*c* has the controller 180 disposed therein and the battery 190 mounted thereto, the moment of inertia of the inner housing 104 is increased, so that vibration of the inner housing 104 is reduced. Furthermore, this structure prevents malfunctioning which may otherwise be caused by repeated contact and separation between the feeding terminal of the battery 190 and the receiving terminal of the battery mounting part 109 in a short time, and prevents welding between the feeding terminal and the receiving terminal which may be caused by the progress of such malfunctioning.

Further, due to the structure in which the front elastic members 110*a* connect the front inner housing region 104*a* and the front outer housing region 102*a*, the intermediate elastic member 110*b* connect the front inner housing region 104*a* and the rear inner housing region 104*c*, and the rear elastic members 110*c* connect the rear inner housing region 104*c* and the rear outer housing region 102*c*, vibration caused in the front inner housing region 104*a* is prevented from being transmitted to the outer housing 102. Therefore, the user can comfortably perform machining operation using the oscillating tool 100 having the vibration reducing structure.

Further, when the brushless motor 115 is rotationally driven, the cooling fan 118 is rotationally driven. Then, air is taken in from the body inlet 101*d*, led into the inner housing 104 through the inlets 104*c*1 and discharged from the outlets 104*a*1 via the air passage 119. By this air flow, the controller 180 arranged immediately downstream of the inlets 104*c*1 and the brushless motor 115 are cooled.

Second Embodiment

An oscillating tool 200 according to a second embodiment of the present invention is now described with reference to FIGS. 14 to 17. The oscillating tool 200 of the second embodiment is different from the oscillating tool 100 of the first embodiment in the structure of the inner housing 104 and the intermediate elastic member.

(Inner Housing)

Figure 14:
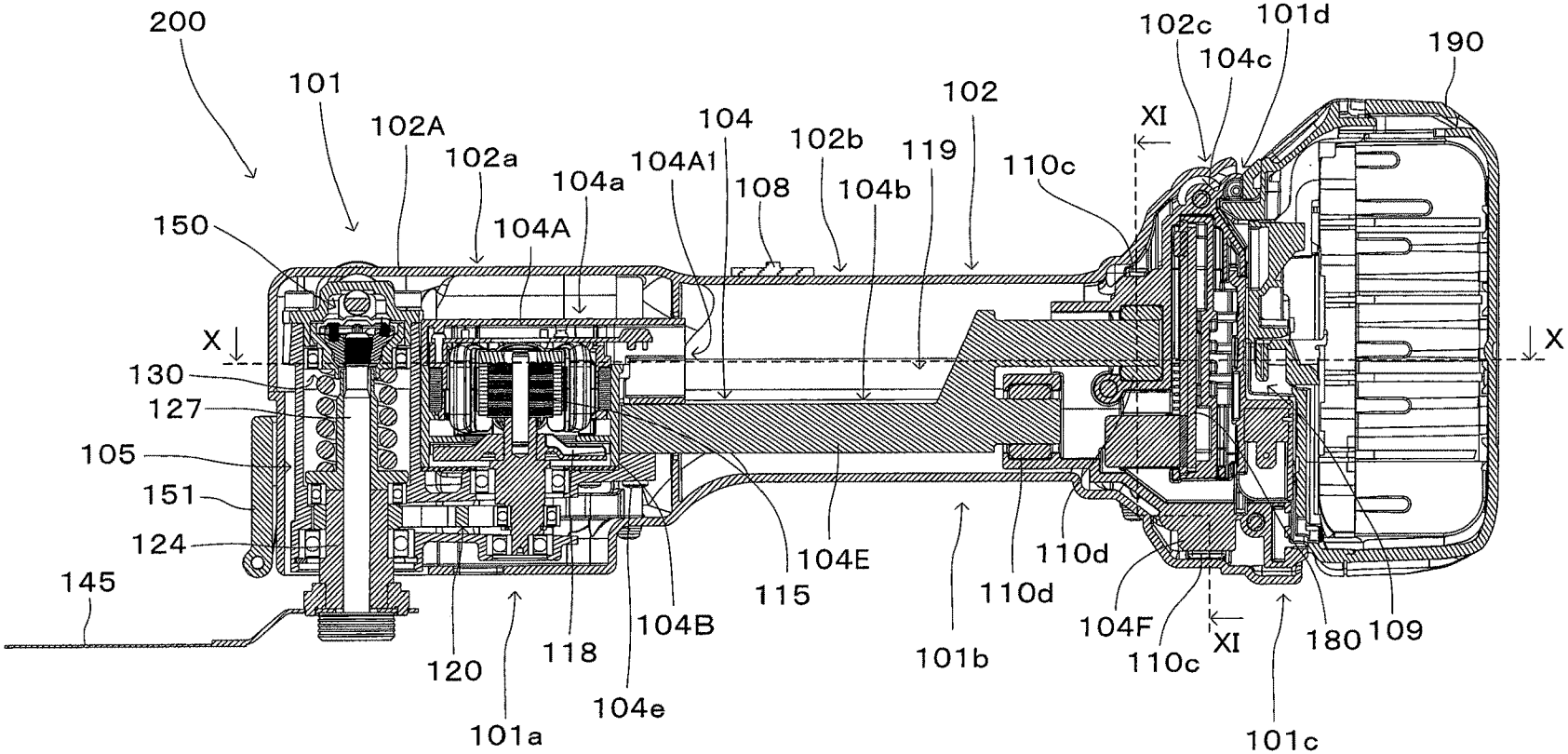
FIG. 14 is a sectional view showing an oscillating tool according to a second embodiment of the present invention.
Figure 15:
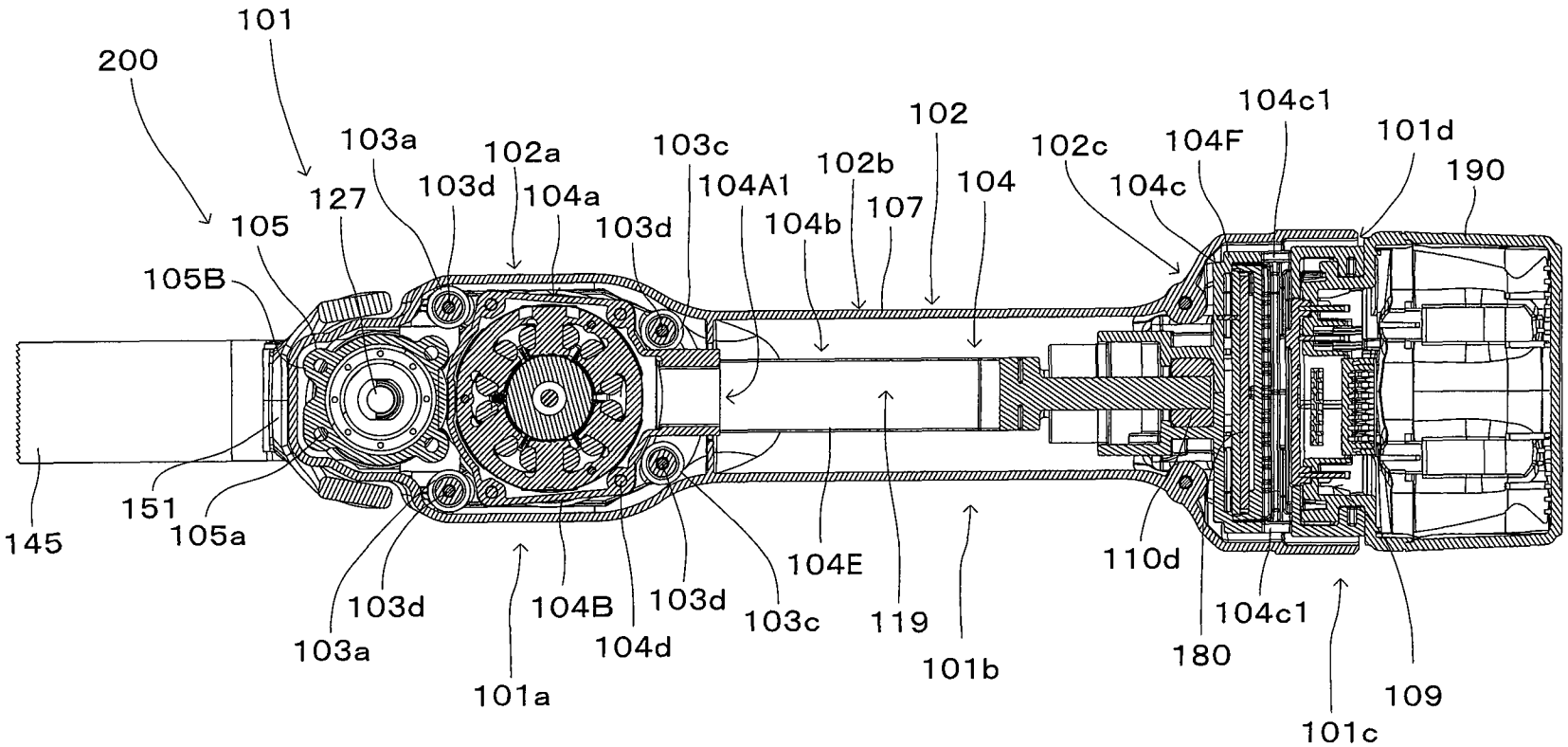
FIG. 15 is a sectional view showing the structure of the body housing.
Figure 16:
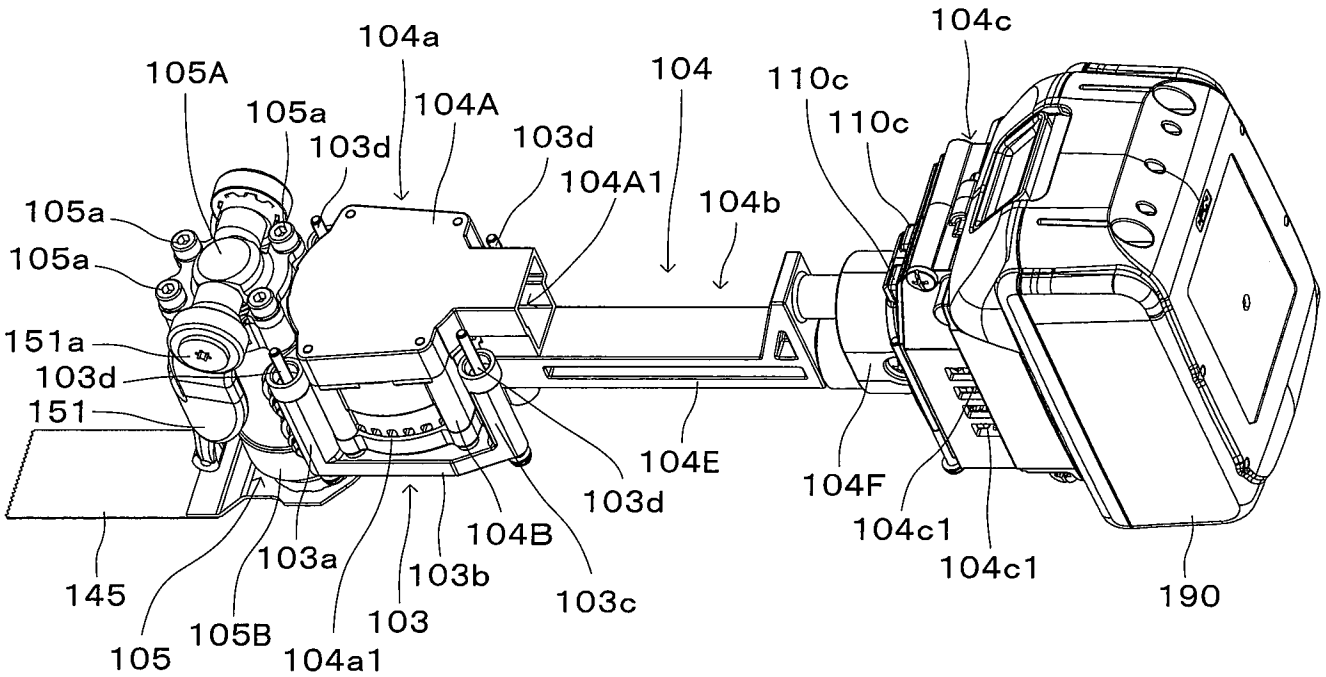
FIG. 16 is a perspective view showing the structures of the inner housing and the intervening member.

As shown in FIGS. 14 to 16, the inner housing 104 of the oscillating tool 200 includes the driving mechanism housing 105, the first inner housing 104A, the second inner housing 104B, a fifth inner housing 104E and a sixth inner housing 104F. FIG. 15 is a sectional view taken along line X-X in FIG. 14, and FIG. 16 is a sectional view taken along line XI-XI in FIG. 14.

The first, second, fifth and sixth inner housings 104A, 104B, 104E, 104F are formed of synthetic resin. The intermediate inner housing region 104*b* mainly includes the fifth inner housing 104E, and the rear inner housing region 104*c* mainly includes the sixth inner housing 104F.

The fifth inner housing 104E and the driving mechanism housing 105 are integrally connected by a fastening member 104*e* shown in FIG. 14. Further, a rear end of the second inner housing 104B and a front end of the fifth inner housing 104E are held in contact with each other. With this structure, the driving mechanism housing 105 and the first, second and fifth inner housings 104A, 104B, 104E are integrated together.

As shown in FIGS. 14 and 15, an enlarged diameter region is formed in a rear region of the sixth inner housing 104F. The controller 180 is disposed within the enlarged diameter region, and the battery mounting part 109 is formed in the enlarged diameter region.

As shown in FIG. 16, inlets 104*c*1 are formed in the rear inner housing region 104*c*, and outlets 104*a*1 are formed in the front inner housing region 104*a*. Further, as shown in FIG. 14, a space part between the intermediate outer housing region 102*b* and the intermediate inner housing region 104*b* forms an air passage 119. As shown in FIGS. 14 and 15, a body inlet 101*d* is formed between the rear outer housing region 102*c* and the rear inner housing region 104*c*.

With this structure, air is caused to flow by rotational driving of the cooling fan 118, taken in from the body inlet 101*d* and discharged from the outlets 104*a*1 via the inlets 104*c*1, the controller 180, the air passage 119 and the brushless motor 115. By this air flow, the controller 180 and the brushless motor 115 are efficiently cooled. Further, a connecting part for electrically connecting the brushless motor 115 and the controller 180 is provided in the air passage 119.

(Elastic Members)

Like in the above-described oscillating tool 100, in the oscillating tool 200, the front inner housing region 104*a* and the front outer housing region 102*a* are connected by the front elastic members 110*a*. Further, as shown in FIG. 17, the sixth inner housing 104F and the rear outer housing region 102*c* are connected by the rear elastic members 110*c*.

Figure 17:
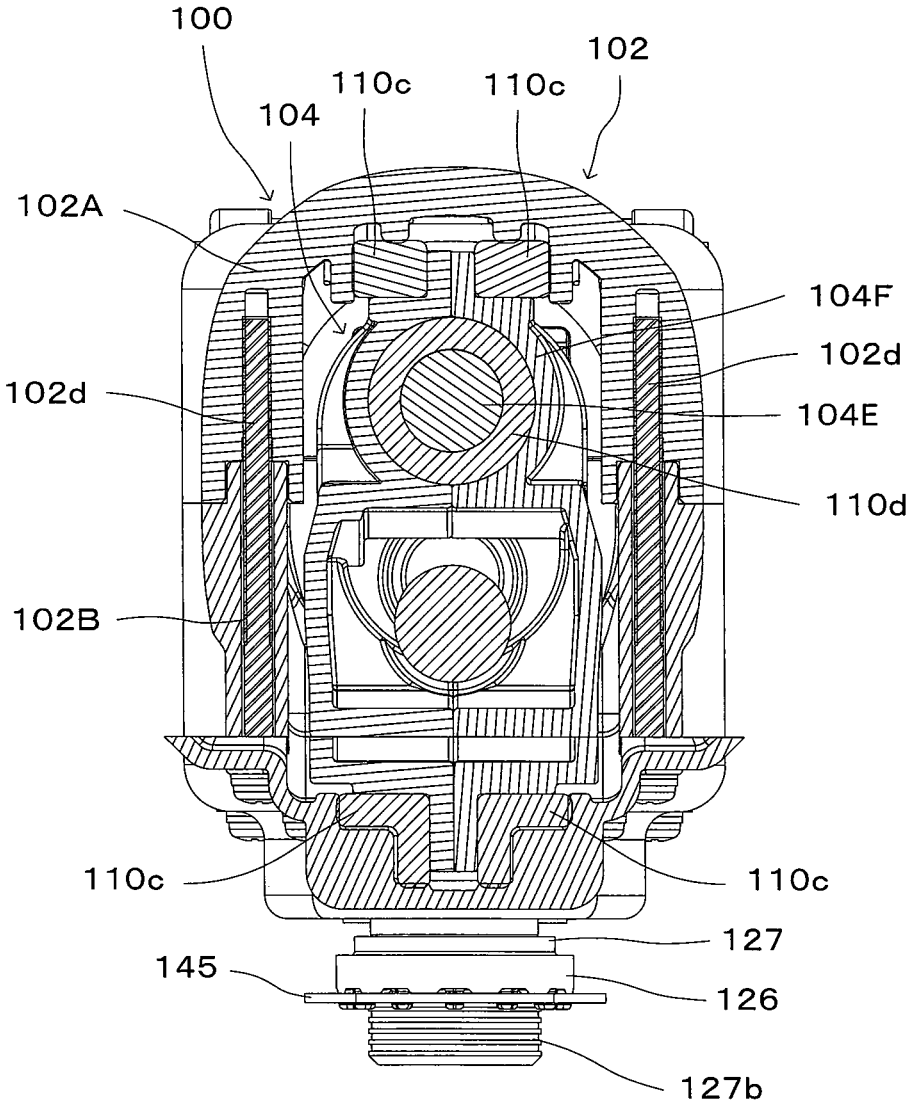
FIG. 17 is a sectional view showing the structures of an intermediate elastic member and the rear elastic members.

As shown in FIGS. 14, 15 and 17, an intermediate elastic member 110*d* is disposed between the fifth inner housing 104E and the sixth inner housing 104F. The intermediate elastic member 110*d* includes two cylindrical rubber elastic elements. As shown in FIG. 14, a rear end part of the fifth inner housing 104E is inserted into the intermediate elastic member 110*d*, and the outer periphery of the intermediate elastic member 110*d* is fitted in contact with a cylindrical elastic-member mounting part of the sixth inner housing 104F. With this structure, the intermediate elastic member 110*d* is held in close contact with both the fifth and sixth inner housings 104E, 104F and integrally connects the fifth and sixth inner housings 104E, 104F. The intermediate elastic member 110*d* is an example embodiment that corresponds to the "intermediate elastic member" according to the present invention. The intermediate elastic member 110*d* effectively prevents vibration caused in the front inner housing region 104*a* from being transmitted to the rear inner housing region 104*c* in all directions.

(Operation for Machining)

Like the oscillating tool 100, the oscillating tool 200 drives the blade 145 to swing by using the brushless motor 115 and the driving mechanism 120 (which are shown in FIG. 14) to perform a machining operation.

In machining, due to the structure in which the front elastic members 110*a* connect the front inner housing region 104*a* and the front outer housing region 102*a*, the intermediate elastic member 110*d* connects the front inner housing region 104*a* and the rear inner housing region 104*c*, and the rear elastic members 110*c* connect the rear inner housing region 104*c* and the rear outer housing region 102*c*, vibration caused in the front inner housing region 104*a* is prevented from being transmitted to the outer housing 102.

Therefore, the user can perform machining operation using the oscillating tool 200 having the vibration reducing structure.

Further, when the brushless motor 115 is rotationally driven, the cooling fan 118 is rotationally driven. Then, air is taken in from the body inlet 101*d* and flows through the inlets 104*c*1, the air passage 119 and the outlets 104*a*1. By this air flow, the controller 180 and the brushless motor 115 are cooled.

In the above-described embodiments, the oscillating tools 100, 200 are described as a representative example of the work tool, but the work tool is not limited to an electric oscillating tool. For example, the present invention may also be applied to a work tool such as a grinder and a circular saw in which the tool accessory rotates. Further, any number of the front elastic members 110*a*, the intermediate elastic members 110*b* (110*d*) and the rear elastic members 110*c* may be provided.

In the above-described embodiments, the brushless motor 115 is powered by the battery 190, but the oscillating tools 100, 200 may be configured to use an external power source in place of the battery 190. Specifically, a power cable which can be connected to the external power source and electrically connected to the controller 180 may be connected to the rear outer housing region 102*c*. When a direct current motor is used as the brushless motor 115, the controller 180 may be configured to have a function as a converter for converting an alternate current supplied from the external power source into a direct current. An alternate current motor may be used as the brushless motor 115. In this case, it is not necessary for the controller 180 to have a function as a converter.

In view of the object of the above-described invention, work tools according the present invention can have the following features. Each feature may be used alone or in combination with others, or in combination with the claimed invention.

(Aspect 1-1)

A body inlet is formed between a rear end part of the outer housing and a rear end part of the inner housing in a longitudinal direction when an extending direction of the elongate outer housing is defined as the longitudinal direction.

(Aspect 1-2)

The front elastic member comprises a plurality of elastic elements spaced apart from each other in a transverse direction, when an extending direction of the rotation axis of the spindle is defined as a vertical direction and a direction crossing the longitudinal direction and the vertical direction is defined as the transverse direction.

(Aspect 1-3)

The rear elastic member comprises a plurality of elastic elements spaced apart from each other in the vertical direction.

(Aspect 2-1)

A work tool, which performs a prescribed operation on a workpiece by driving a tool accessory, comprising:

a housing extending in an elongate form, a brushless motor, a controller for controlling driving of the brushless motor, and a spindle having a rotation axis extending in parallel to a rotation output shaft of the brushless motor and configured to be rotated on the rotation axis within a prescribed angular range via the brushless motor to drive the tool accessory, wherein:

in a longitudinal direction which is defined as an extending direction of the elongate housing, the housing has a front housing region that defines a front region of the housing, a rear housing region that defines a rear region of the housing, and an intermediate housing region that defines an intermediate part between the front housing region and the rear housing region, at least the brushless motor is disposed in the front inner housing region, and the controller is disposed in the rear inner housing region.

(Aspect 2-2)

The work tool as defined in the aspect 2-1, further comprising:

an outer housing, an inner housing comprising the housing and housed within the outer housing, an elastic member configured to elastically connect the outer housing and the inner housing to prevent vibration caused in the inner housing from being transmitted to the outer housing.

(Aspect 2-3)

The work tool as defined in the aspect 2-1 or 2-2, further comprising an inlet formed in the rear housing region, an outlet formed in the front housing region and an air passage formed within the intermediate housing region, wherein the controller and the brushless motor are arranged on an air flow path extending from the inlet to the outlet via the air passage.

(Aspect 2-4)

The work tool as defined in the aspect 2-2, further comprising an inlet formed in the rear housing region, an outlet formed in the front housing region and an air passage formed between the intermediate housing region and the outer housing, wherein the controller and the brushless motor are arranged on an air flow path extending from the inlet to the outlet via the air passage.

(Aspect 2-5)

The work tool as defined in the aspect 2-3 or 2-4, wherein the controller is disposed within the rear inner housing region and immediately downstream of the inlet through which air is sucked in.

(Aspect 2-6)

The work tool as defined in any one of the aspects 2-3 to 2-5, further comprising a connecting part for electrically connecting the controller and the brushless motor, wherein the connecting part is at least partly arranged in the air passage.

(Aspect 2-7)

The work tool as defined in any one of the aspects 2-1 to 2-6, wherein a body inlet is formed between a rear end part of the outer housing and a rear end part of the housing (or inner housing).

(Aspect 2-8)

The work tool as defined in any one of the aspects 2-1 to 2-7, wherein the front elastic member comprises a plurality of elastic elements spaced apart from each other in a transverse direction, when an extending direction of the rotation axis of the spindle is defined as a vertical direction and a direction crossing the longitudinal direction and the vertical direction is defined as the transverse direction.

(Aspect 2-9)

The work tool as defined in any one of the aspects 2-1 to 2-8, wherein the rear elastic member comprises a plurality of elastic elements spaced apart from each other in the vertical direction.

(Correspondences Between the Features of the Embodiments and the Features of the Invention)

Correspondences between the features of the embodiments and the features of the invention are as follows. The above-described embodiments are representative examples for embodying the present invention, and the present invention is not limited to the structures that have been described as the representative embodiments.

The oscillating tool 100, 200 is an example embodiment that corresponds to the "work tool" according to the present invention. The blade 145 is an example embodiment that corresponds to the "tool accessory" according to the present invention. The outer housing 102 and the inner housing 104 are example embodiments that correspond to the "outer housing" and the "inner housing", respectively, according to the present invention. The front outer housing region 102*a*, the rear outer housing region 102*c* and the intermediate outer housing region 102*b* are example embodiments that correspond to the "front outer housing region", the "rear outer housing region" and the "intermediate outer housing region", respectively, according to the present invention. The front inner housing region 104*a*, the intermediate inner housing region 104*b* and the rear inner housing region 104*c* are example embodiments that correspond to the "front inner housing region", the "intermediate inner housing region" and the "rear inner housing region", respectively, according to the present invention. The thin part 107 is an example embodiment that corresponds to the "thin part" according to the present invention. The brushless motor 115 is an example embodiment that corresponds to the "brushless motor" according to the present invention. The battery 190 and the battery mounting part 109 are example embodiments that correspond to the "battery" and the "battery mounting part", respectively, according to the present invention. The inlet 104*c*1, the outlet 104*a*1, the cooling fan 118 and the air passage 119 are example embodiments that correspond to the "inlet", the "outlet", the "cooling fan" and the "air passage", respectively, according to the present invention. The connecting part is an example embodiment that corresponds to the "connecting part" according to the present invention. The front elastic member 110*a* is an example embodiment that corresponds to the "front elastic member" according to the present invention. The rear elastic member 110*c* is an example embodiment that corresponds to the "rear elastic member" according to the present invention. The intermediate elastic member 110*b*, 110*d* is an example embodiment that corresponds to the "intermediate elastic member" according to the present invention. The spindle 124 is an example embodiment that corresponds to the "spindle" according to the present invention.

DESCRIPTION OF THE NUMERALS

100, 200 oscillating tool (work tool)
101 body housing
101*a* front body housing region
101*b* intermediate body housing region
101*c* rear body housing region
101*d* body inlet
102 outer housing
102A first outer housing
102B second outer housing
102*a* front outer housing region
102*b* intermediate outer housing region
102*c* rear outer housing region
102*c*1 projection
102*c*2 projection
102*d* fastening member
103 intervening member
103*a* front intervening member region
103*a*1 projection
103*b* intermediate intervening member region
103*c* rear intervening member region
103*d* fastening member
104 inner housing
104A first inner housing
104A1 opening
104B second inner housing
104C third inner housing
104D fourth inner housing
104E fifth inner housing
104F sixth inner housing
104*a* front inner housing region
104*a*1 outlet
104*b* intermediate inner housing region
104*c* rear inner housing region
104*c*1 inlet
104*d* fastening member
104*e* fastening member
104*f* fastening member
105 driving mechanism housing
105A first driving mechanism housing
105B second driving mechanism housing
105*a* fastening member
107 thin part
108 slide switch
109 battery mounting part
110*a* front elastic member
110*b* intermediate elastic member
110*c* rear elastic member
110*d* intermediate elastic member
115 brushless motor
115*a* output shaft
118 cooling fan
119 air passage
120 driving mechanism
121 eccentric shaft
121*a* eccentric part
121*b* bearing
121*c* bearing
122 drive bearing
123 driven arm
123*a* arm part
123*b* fixed part
124 spindle
124*a* bearing
124*b* bearing
126 tool holding part
127 clamp shaft (tool accessory holding member)
127*a* engagement groove part
127*b* clamp head
130 lock mechanism
131 clamp member
131*a* clamp member inclined part
134 first coil spring
135 collar member
135*a* collar member inclined part
135*b* bearing
137 lid member
140 biasing mechanism
141 support member
141*a* coil spring support part
141*b* clamp member support part
142 second coil spring
145 blade (tool accessory)
150 lock operation mechanism
151 handle part
151*a* pivot shaft
151*b* cam
151*c* eccentric shaft
180 controller
190 battery

The invention claimed is:

1. A work tool, which performs a prescribed operation on a workpiece by driving a tool accessory, comprising:

an outer housing extending in an elongate form along a longitudinal axis, an inner housing provided in the outer housing, a brushless motor having a rotational output shaft, and a spindle having a rotation axis extending in parallel to the rotational output shaft of the brushless motor and configured to be rotated on the rotation axis within a prescribed angular range via the brushless motor to drive the tool accessory, along the longitudinal axis, the outer housing having a front outer housing region that defines a front part of the outer housing, a rear outer housing region that defines a rear part of the outer housing, and an intermediate outer housing region that defines an intermediate part between the front outer housing region and the rear outer housing region so as to be held by a user, the inner housing having: a front inner housing region that is arranged within the front outer housing region and houses at least the brushless motor and the entire spindle, except for a portion of the spindle to which the tool accessory is attached; a rear inner housing region that is arranged within the rear outer housing region; and an intermediate inner housing region that is arranged within the intermediate outer housing region, a front elastic member disposed between the front inner housing region and the front outer housing region, and a rear elastic member disposed between at least one of the intermediate inner housing region and the rear inner housing region and at least one of the intermediate outer housing region and the rear outer housing region;

wherein the rotational output shaft and the rotation axis are perpendicular to the longitudinal axis.

2. The work tool as defined in claim 1, further comprising an intermediate elastic member provided at a prescribed location in an area from the front inner housing region to the rear inner housing region via the intermediate inner housing region and configured to elastically connect the front inner housing region to at least the rear inner housing region.

3. The work tool as defined in claim 2, wherein at least part of the intermediate inner housing region is flexible and the flexible part defines the intermediate elastic member.

4. The work tool as defined in claim 1, wherein a battery mounting part is provided in the rear inner housing region and a battery for supplying power to the brushless motor is mounted to the battery mounting part.

5. The work tool as defined in claim 1, further comprising:

a controller for controlling driving of the brushless motor, a connecting part for electrically connecting the brushless motor and the controller, a cooling fan, inlets through which air is take in from outside via the cooling fan, and outlets through which air is discharged to the outside, wherein:

the inlets are formed in the rear inner housing region, the outlets are formed in the front inner housing region, an air passage is formed in the intermediate inner housing and configured to provide communication between the inlets and the outlets, and at least part of the connecting part is arranged in the air passage.

6. The work tool as defined in claim 1, wherein the intermediate outer housing region has a thin part having a smaller width than the front and rear outer housing regions in a transverse direction, when an extending direction of the rotation axis of the spindle is defined as a vertical direction and a direction crossing the longitudinal direction and the vertical direction is defined as the transverse direction.

7. The work tool as defined in claim 1, further comprising a controller for controlling driving of the brushless motor, wherein at least the brushless motor is disposed in the front inner housing region and the controller is disposed in the rear inner housing region.

8. The work tool as defined in claim 1, wherein the front elastic member is disposed between and contacts the front inner housing region and the front outer housing region in three dimensions to dampen vibrations in the three dimensions.

9. The work tool as defined in claim 1, wherein the rear elastic member is disposed between and contacts at least one of the intermediate inner housing region and the rear inner housing region and at least one of the intermediate outer housing region and the rear outer housing region in three dimensions to dampen vibrations in the three dimensions.

10. The work tool as defined in claim 1, wherein the front elastic member comprises four members that form pairs of vertically and transversely spaced members.

11. The work tool as defined in claim 1, wherein the rear elastic member comprises four members that form pairs of vertically spaced and transversely spaced members.

12. A work tool, which performs a prescribed operation on a workpiece by driving a tool accessory, comprising:

an outer housing extending in an elongate form along a longitudinal axis, an inner housing provided in the outer housing, a brushless motor having a rotational output shaft, and a spindle having a rotation axis extending in parallel to the rotational output shaft of the brushless motor and configured to be rotated on the rotation axis within a prescribed angular range via the brushless motor to drive the tool accessory, along the longitudinal axis, the outer housing having a front outer housing region that defines a front part of the outer housing, a rear outer housing region that defines a rear part of the outer housing, and an intermediate outer housing region that defines an intermediate part between the front outer housing region and the rear outer housing region, the inner housing having: a front inner housing region that is arranged within the front outer housing region and houses at least the brushless motor and the entire spindle, except for a portion of the spindle to which the tool accessory is attached; a rear inner housing region that is arranged within the rear outer housing region; and an intermediate inner housing region that is arranged within the intermediate outer housing region, a front elastic member disposed between the front inner housing region and the front outer housing region, and an intermediate elastic member provided at a prescribed location in an area from the front inner housing region to the rear inner housing region via the intermediate inner housing region and configured to elastically connect the front inner housing region to at least the rear inner housing region;

wherein the rotational output shaft and the rotation axis are perpendicular to the longitudinal axis.

13. The work tool as defined in claim 12, wherein at least part of the intermediate inner housing region is flexible and the flexible part defines the intermediate elastic member.

14. A work tool, which performs a prescribed operation on a workpiece by driving a tool accessory, comprising:

an outer housing extending in an elongate form along a longitudinal axis, an inner housing provided in the outer housing, a brushless motor having a rotational output shaft, and a spindle having a rotation axis extending in parallel to the rotational output shaft of the brushless motor and configured to be rotated on the rotation axis within a prescribed angular range via the brushless motor to drive the tool accessory, along the longitudinal axis, the outer housing having a front outer housing region that defines a front part of the outer housing, a rear outer housing region that defines a rear part of the outer housing, and an intermediate outer housing region that defines an intermediate part between the front outer housing region and the rear outer housing region so as to be held by a user, the inner housing having: a front inner housing region that is arranged within the front outer housing region and houses at least the brushless motor and the entire spindle, except for a portion of the spindle to which the tool accessory is attached; a rear inner housing region that is arranged within the rear outer housing region; and an intermediate inner housing region that is arranged within the intermediate outer housing region, a front elastic member disposed between the front inner housing region and the front outer housing region, and a rear elastic member disposed between at least one of the intermediate inner housing region and the rear inner housing region and at least one of the intermediate outer housing region and the rear outer housing region;

wherein the rotational output shaft and the rotation axis are on separate, but parallel, axes, wherein the rotational output shaft and the rotation axis are perpendicular to the longitudinal axis.

15. A work tool, which performs a prescribed operation on a workpiece by driving a tool accessory, comprising:

an outer housing extending in an elongate form along a longitudinal axis, an inner housing provided in the outer housing, a brushless motor having a rotational output shaft, and a spindle having a rotation axis extending in parallel to the rotational output shaft of the brushless motor and configured to be rotated on the rotation axis within a prescribed angular range via the brushless motor to drive the tool accessory, along the longitudinal axis, the outer housing having a front outer housing region that defines a front part of the outer housing, a rear outer housing region that defines a rear part of the outer housing, and an intermediate outer housing region that defines an intermediate part between the front outer housing region and the rear outer housing region, the inner housing having: a front inner housing region that is arranged within the front outer housing region and houses at least the brushless motor and the entire spindle, except for a portion of the spindle to which the tool accessory is attached; a rear inner housing region that is arranged within the rear outer housing region; and an intermediate inner housing region that is arranged within the intermediate outer housing region, a front elastic member disposed between the front inner housing region and the front outer housing region, and an intermediate elastic member provided at a prescribed location in an area from the front inner housing region to the rear inner housing region via the intermediate inner housing region and configured to elastically connect the front inner housing region to at least the rear inner housing region;

wherein the rotational output shaft and the rotation axis are on separate, but parallel, axes, wherein the rotational output shaft and the rotation axis are perpendicular to the longitudinal axis.

* * * * *